US009194147B2

(12) United States Patent
Campodonico

(10) Patent No.: US 9,194,147 B2
(45) Date of Patent: Nov. 24, 2015

(54) MODULAR SWIMMING POOL

(71) Applicant: Mario L. Campodonico, Castaic, CA (US)

(72) Inventor: Mario L. Campodonico, Castaic, CA (US)

( * ) Notice: Subject to any disclaimer, the term of this patent is extended or adjusted under 35 U.S.C. 154(b) by 289 days.

(21) Appl. No.: 14/060,961

(22) Filed: Oct. 23, 2013

(65) Prior Publication Data

US 2014/0173820 A1 Jun. 26, 2014

Related U.S. Application Data

(60) Provisional application No. 61/745,254, filed on Dec. 21, 2012.

(51) Int. Cl.
*E04H 4/00* (2006.01)

(52) U.S. Cl.
CPC ..... *E04H 4/0031* (2013.01)

(58) Field of Classification Search
CPC ..... E04H 4/0031; E04H 4/00
USPC ..... 4/506, 513
See application file for complete search history.

(56) References Cited

U.S. PATENT DOCUMENTS

| | | | | |
|---|---|---|---|---|
| 3,564,791 | A * | 2/1971 | Arp | E04H 4/0043 4/506 |
| 3,869,736 | A | 3/1975 | Valois et al. | |
| 3,971,075 | A | 7/1976 | Heinbaugh et al. | |
| 4,062,158 | A | 12/1977 | Kaufmann et al. | |
| 4,562,603 | A | 1/1986 | Paradis | |
| 4,847,926 | A | 7/1989 | Laputka | |
| 4,860,914 | A * | 8/1989 | Derni | E04H 4/0031 220/4.16 |
| 4,932,085 | A | 6/1990 | Saj | |
| 4,974,266 | A | 12/1990 | Vultaggio et al. | |
| 5,054,135 | A | 10/1991 | Dallaire et al. | |
| 5,083,327 | A | 1/1992 | Gillebaard | |
| 5,114,274 | A | 5/1992 | Heiler, Jr. | |
| 5,454,195 | A * | 10/1995 | Hallsten | B65D 90/24 220/495.01 |
| 5,603,129 | A | 2/1997 | Chou | |
| D427,693 | S | 7/2000 | Mussa | |
| 6,272,696 | B1 | 8/2001 | Sobel et al. | |
| 6,421,846 | B1 | 7/2002 | Shaanan et al. | |
| 6,571,404 | B2 | 6/2003 | Hall | |
| 8,074,406 | B2 | 12/2011 | Ksenych et al. | |
| 8,215,069 | B2 | 7/2012 | Epple | |
| 2009/0144892 | A1 | 6/2009 | Brindle | |
| 2013/0152297 | A1 * | 6/2013 | Ludlow | E04H 4/14 4/506 |

FOREIGN PATENT DOCUMENTS

| | | |
|---|---|---|
| EP | 1898030 A2 | 3/2008 |
| GB | 245514 A | 6/2009 |
| RU | 31594 U1 | 8/2003 |

OTHER PUBLICATIONS

International Search Authority (Russia), ISR/WO for International Application No. PCT/US2013/074793 (Campodonico, Mario L.) (F. Dec. 12, 2013), dated Apr. 29, 2014, pp. 1-6.

* cited by examiner

*Primary Examiner* — Huyen Le
(74) *Attorney, Agent, or Firm* — John D. Carpenter

(57) ABSTRACT

A modular swimming pool is constructed of one or more floor sections and a plurality of wall sections, with water-tight seams between the sections. Grooves formed in the sides of each section mate with corresponding grooves on adjacent sections and thereby form hollow channels that hold elastomeric seals. A plurality of fasteners applies compressive force to the seals, which results in formation of a water-tight seam. A skirt, also provided in sections, is attached to the wall sections and forms a structural and decorative part of the pool.

28 Claims, 36 Drawing Sheets

30

30

32b
31a
32a 37
62
36

31c

MODULAR SWIMMING POOL

CROSS-REFERENCE TO RELATED APPLICATION

This application claims the benefit of U.S. Provisional Application No. 61/745,254, filed Dec. 21, 2012. The entire contents of the provisional application are incorporated by reference herein.

FIELD OF THE INVENTION

The invention relates to swimming pools, spas, and storage tanks for liquids.

BACKGROUND OF THE INVENTION

Above-ground swimming pools typically have a tubular support structure that supports a water-proof liner. For anything other than the smallest pools, the structures are usually difficult to erect and are prone to being damaged. The liner is especially vulnerable. In addition, unless the underlying surface is swept absolutely clean of pebbles and other debris, the liner, once laid in place, will not be smooth, which can be both unsightly and uncomfortable to the touch. If, for example, the liner is inadvertently laid over a rock or pebble, a swimmer may step on the unseen object and possibly injure himself and the liner. Remedying the situation requires a pool owner to drain the pool, remove the liner, and reassemble and fill the pool, which is quite time-consuming.

The patent literature describes a number of above-ground pool, spas, and liquid storage tanks. For example, U.S. Pat. No. 4,974,266 discloses a swimming pool structure for on-site assembly, which comprises a flexible liner supported by a surrounding wall of side-by side wooden staves and a plurality of cables that pass entirely around the pool wall. U.S. Pat. No. 5,054,135 discloses a molded modular plastic framework for a swimming pool, which comprises an endless molded base member having post sockets and a continuous cove, the molded members being connected end to end to make the endless base member. U.S. Pat. No. 5,114,274 discloses a sewage collection and separation tank that uses as hexagonal elastromeric gasket mounted at a groove, with one end of the gasket abutting against another gasket mounted in the side of the sump pit to provide a liquid-tight seal. U.S. Pat. No. 3,971,075 discloses a swimming pool structure comprising a plurality of panels forming the pool walls and floor, the panels being interconnected by elastomeric sealing members that bridge adjacent panels and contact the front faces thereof. The interconnections have a complex design that employs both a seal and a cover member. Despite these past attempts, a need remains for above ground swimming pools, spas, and related structures that do not require a liner and that are structurally sound, easy to assemble, and aesthetically pleasing.

SUMMARY OF THE INVENTION

According to one aspect of the invention, a modular swimming pool is provided and comprises at least one floor section, each floor section having a top surface, a bottom surface, and one or more sides, each side having at least one groove formed therein; a plurality of wall sections attached to the floor section(s), each wall section having at least one groove formed therein; a plurality of channels, the channels being formed by complementary pairs of the grooves in adjacent wall sections and/or floor sections; a plurality of elastomeric seals seated in the plurality of channels; and a plurality of fasteners located near each channel and seeming the plurality of wall sections to each other and/or to the at least one floor section; wherein the elastomeric seals and fasteners create water-tight joints between adjacent wall sections and/or floor sections. The swimming pool is made of any suitably strong, water-proof polymer, fiberglass, or other suitable material, and is designed to be easy to assemble. Advantageously, no swimming pool liner is required.

BRIEF DESCRIPTION OF THE DRAWINGS

Various features and embodiments of the invention will be more readily understood when considered in light of the accompanying drawings, wherein.

DETAILED DESCRIPTION OF THE INVENTION

Figure 1:
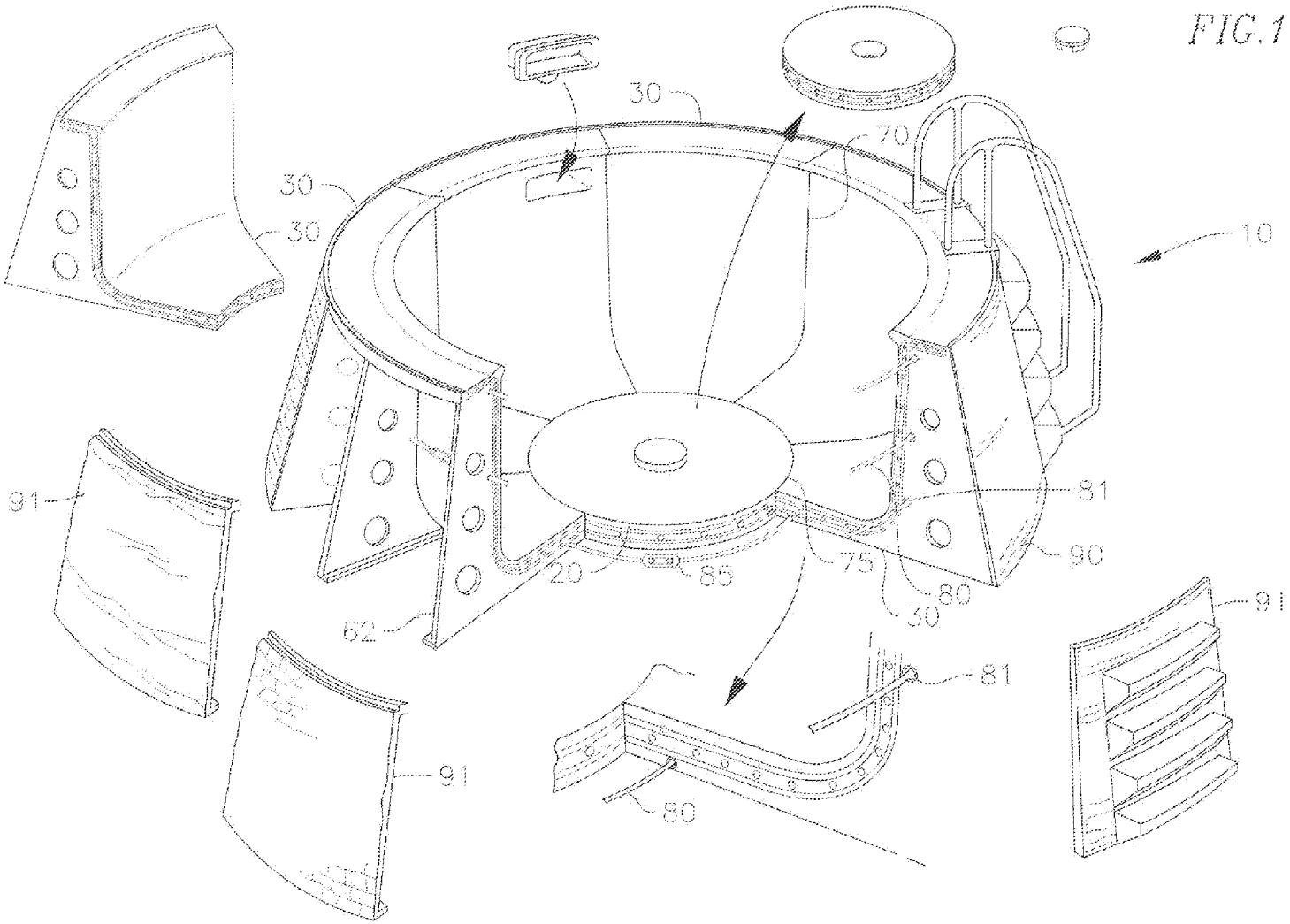
FIG. 1 is a perspective, partial sectional schematic view of a circular swimming pool according to one embodiment of the invention.

According to the invention, an above-ground swimming pool, spa, or storage tank is formed of a number of modular sections. FIG. 1 shows one embodiment of such a swimming pool. The pool 10 is constructed of a central floor section 20 and multiple wall sections 30. Adjacent wall sections meet at water-tight joints or seams 70, and each wall section meets the central floor section at a water-tight seam 75. Two or more cables 80 wrap around the swimming pool and provide additional structural integrity, and a decorative skirt 90 composed of individual skirt sections 91, forms the outer perimeter of the pool.

Figure 3:
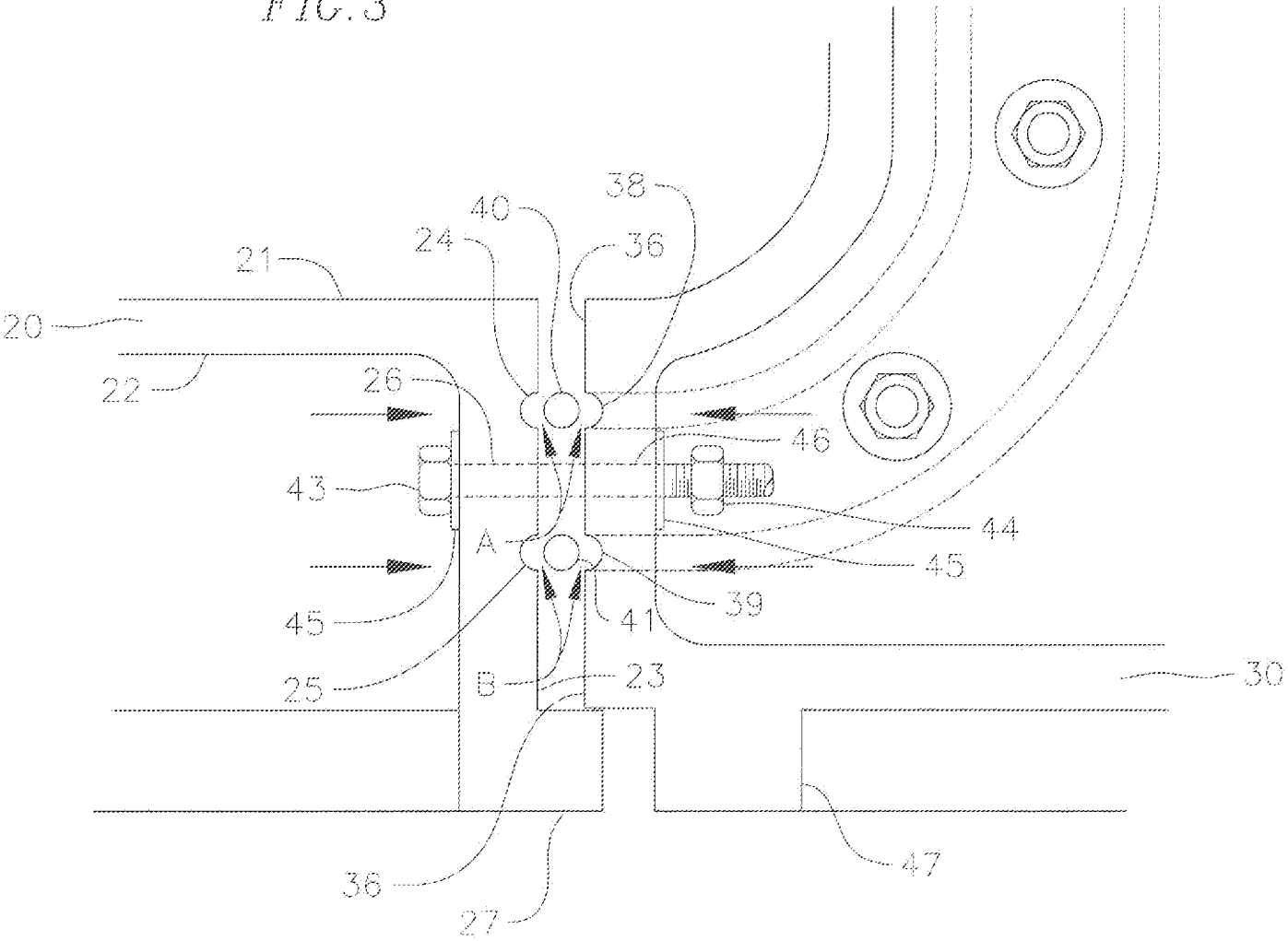
FIG. 3 is a close-up sectional view of a pool wall section adjacent to a pool floor section according to one embodiment of the invention, with elastormeric seals in place between the pool wall section and the pool floor section.

The floor section 20 has a top surface 21, a bottom surface 22, and a side 23 (see FIG. 3). A pair of parallel grooves 24, 25 is formed in the side 23 of the floor section and, together with corresponding grooves in adjacent wall sections, forms channels that hold elastomeric seals. This is described below in more detail. In between the grooves are a plurality of holes 26, which extend all the way through the side, as described below. A foot 27 (described below) extends laterally from the floor section side, away from the center of the pool.

The side 23 of the floor section 20 extends downwardly along the perimeter of the floor section and serves as a load-bearing support member. Preferably, one or more additional support members, adapted to support the weight of the floor section and the water that will fill the pool, also extend from the bottom surface of the central floor section 20. For example, in the embodiment shown in FIGS. 13 and 14 the floor section 20 has concentric rings 28 and radially directed arms 29 extending from the bottom surface 22 of the pooh in FIGS. 15*g*, 15*h*, 17*g*, 18*g*, 19*g*, and 20*g* the floor section includes a subfloor 12 having a structure similar to a waffle or a honeycomb, with a series of crests and troughs that provide load-hearing support. Alternatively, the undersurface of the pool has some other geometry, such as parallel beams, which may be connected with crosspieces; hexagonal grids; and the like.

Figure 2B:
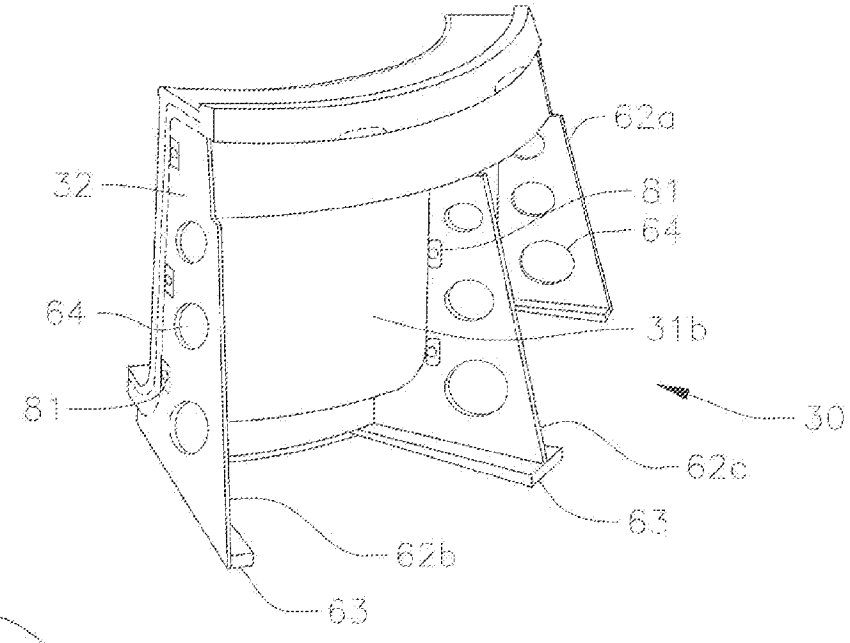
FIG. 2*b* is a perspective view of the back (exterior side) of be pool wall section shown in FIG. 2*a;*
Figure 2A:
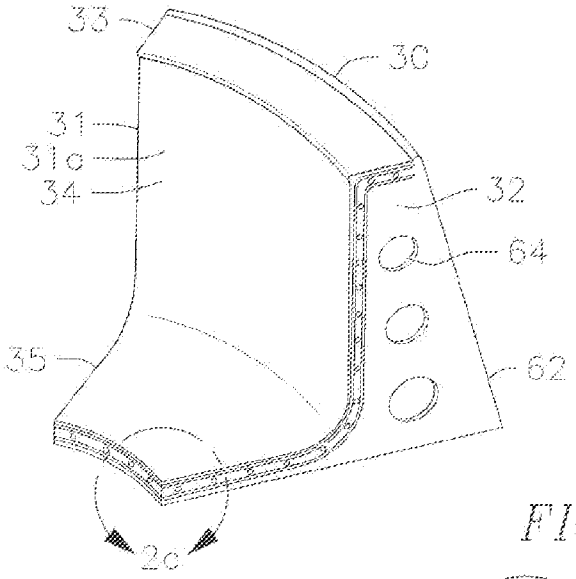
FIG. 2*a* is a perspective view of the front (interior side) of a pool wall section according to one embodiment of the invention.
Figure 2C:
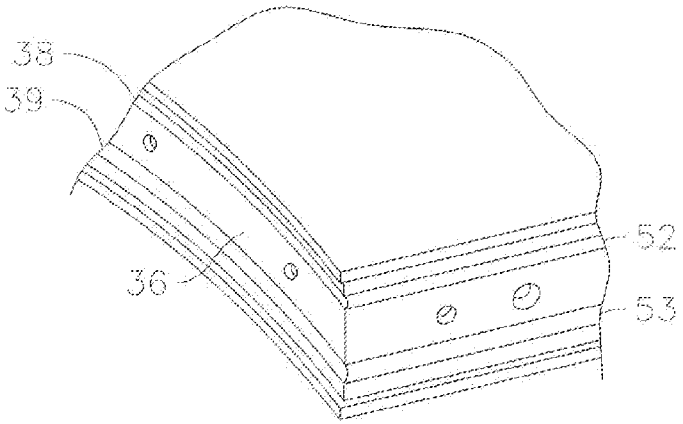
FIG. 2*c* is a close-up perspective view of a lower cornet of the pool wall section shown in FIGS. 2*a* and 2*b;*

FIGS. 2*a* and 2*b* show front (pool-facing) and rear views of a typical wall section 30, which is substantially wedge-shaped when viewed from above. Each wall section has a main panel 31 and two side panels 32. The main panel of each wall section includes an upper portion 33 which forms a coping or sub-coping; a middle portion 34, which accounts for most of the surface area of the wall section main panel; and a lower portion 35, which is directed toward the central floor section 20. In addition, the main pool panel 31 has a front (pool-facing) surface 31*a* and a back or rear (outwardly facing) surface 31*b*. Where the main panel 31 abruptly ends at its lower portion 35, a face 36 provides a surface that abuts the side 23 of the adjacent floor section 20. In the embodiment shown in the drawings, the lower portion 35 of the main panel forms part of the floor of the pool. In addition, the top or upper portion 33 of the main panel 31 of each wait section is wide enough to stand on and, in some embodiments, mount a ladder. In some embodiments, additional decking is mounted to this upper portion. As shown in FIGS. 1 and 2, the upper portion of the main panel includes a slight lip 37 that projects inwardly toward the center of the pool.

Each wall section 30 meets the central floor section 20 at a water-tight seam or joint 75. As is shown in detail in FIGS. 3-5, a pair of parallel grooves 38, 39 is formed in the face 36 of each wall section. These grooves complement and line up with the corresponding grooves 24, 25 in the adjacent floor panel 20, and thereby form two channels A, B. An elastomeric seal 40, 41 is seated in each channel and is compressed by the applied force of a plurality of fasteners, e.g., bolts 43, nuts 44, and washers 45. The bolts extend through holes 46 in the face 36 of each wall section and holes 26 in the side 23 of the floor section. The holes are preferably located along an imaginary line that lies between—and is parallel to—the two channels A, B. To further index each wall section 30 with the central floor section 20, a leg or support member 47 extends downwardly from each side panel of each wall section and serves as a stop for the corresponding foot 27 on the adjacent floor panel.

In a similar manner, each wall section meets two adjacent wall sections at water-tight seams or joints 70. FIGS. 2*a*, 2*b*, 2*c*, and 6 show a typical wall section 30, which includes a pair of side panels 32*a*, 32*b* that extend from the edge of the wall section's main panel 31. A pair of grooves, 52, 53 is firmed in the outer surface of each side panel. Thus, both the left side panel 32*a* and the right side panel 32*b* of each wall section have pairs of grooves, similar to the grooves 38, 39 formed in the face 36 of each wall section. When each wall section abuts an adjacent wall section, corresponding pairs of grooves line up to form channels, and elastomeric seals are seated in the channels to form water-tight seams or joints between the wall sections.

Figure 7:
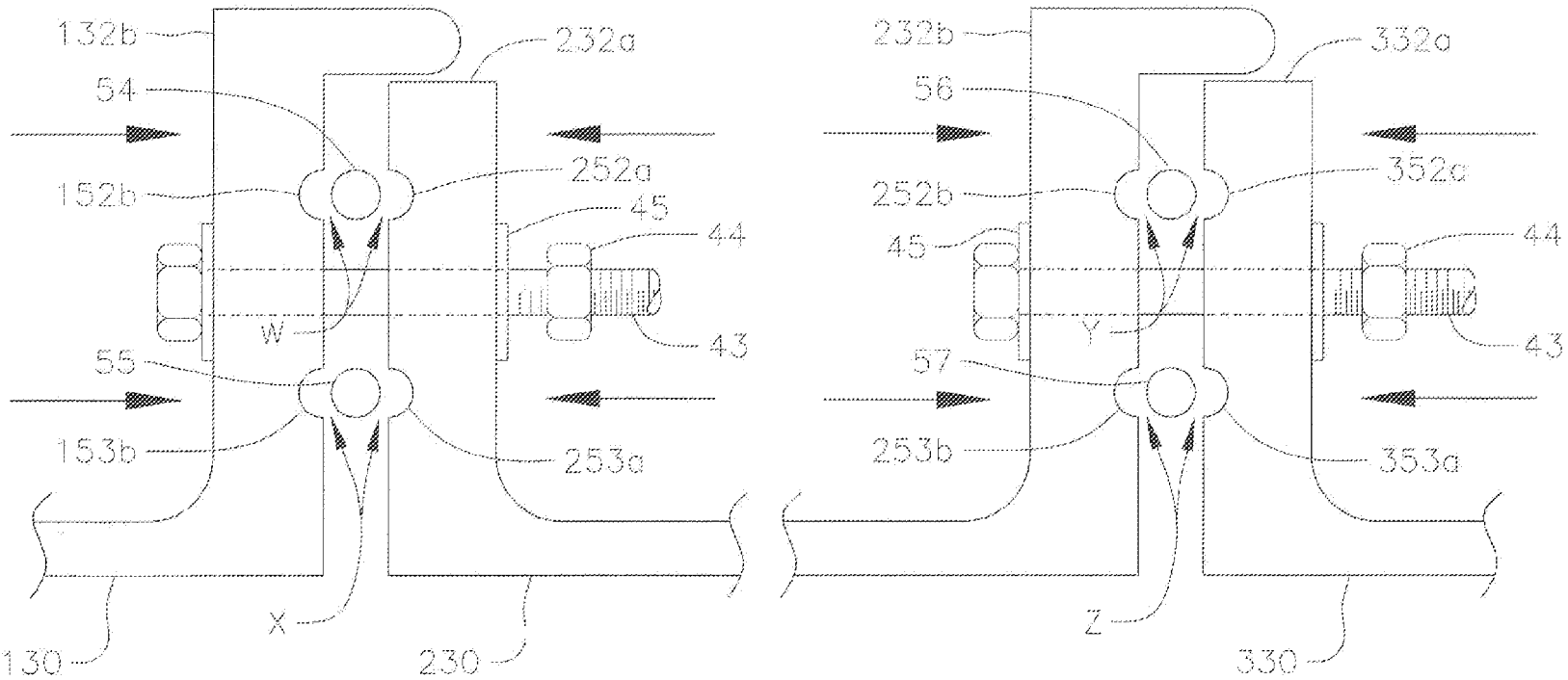
FIG. 7 is a top sectional view of two adjacent pool wall sections according to one embodiment of the invention.

In FIG. 7, three wall sections are positioned side by side, in a slightly exploded configuration. The view is from the top, with the interior of the pool at the bottom of the page and the wall sections depicted in cross section. (The concave curvature of the wall sections has been omitted for clarity.) For convenience, the three wall sections are labeled 130, 230, and 330, respectively. The right, side panel 132*b* of the first (left) wall section 130 is shown; the left side panel 232*a* and right side panel 232*b* of the second (middle) wall section 230 are shown; and the left side panel 332*a* of the third (right) wall section 330 is shown. When the three wall sections are brought side by side, corresponding grooves in the side panels line up and form channels adapted to hold elastomeric seals, and thereby form water-tight seams or joints between the wall sections. Thus, grooves 152*b* and 153*b* in the right side panel 132*b* of the first wall section 130 line up with grooves 252*a* and 253*a* in the lei side panel 232*a* of the second (middle) wall section, while grooves 352*a* and 353*a* in the left side panel 332*a* of the third wall section 330 line up with grooves 252*b* and 253*b* in the right side panel 232*b* of the second (middle) wall section 230. Where each groove lines up with a complementary groove, a channel is formed. In FIG. 7, the arrows indicate where the channels—x, y, z—will be formed once the wall sections are brought together completely.

Figure 6:
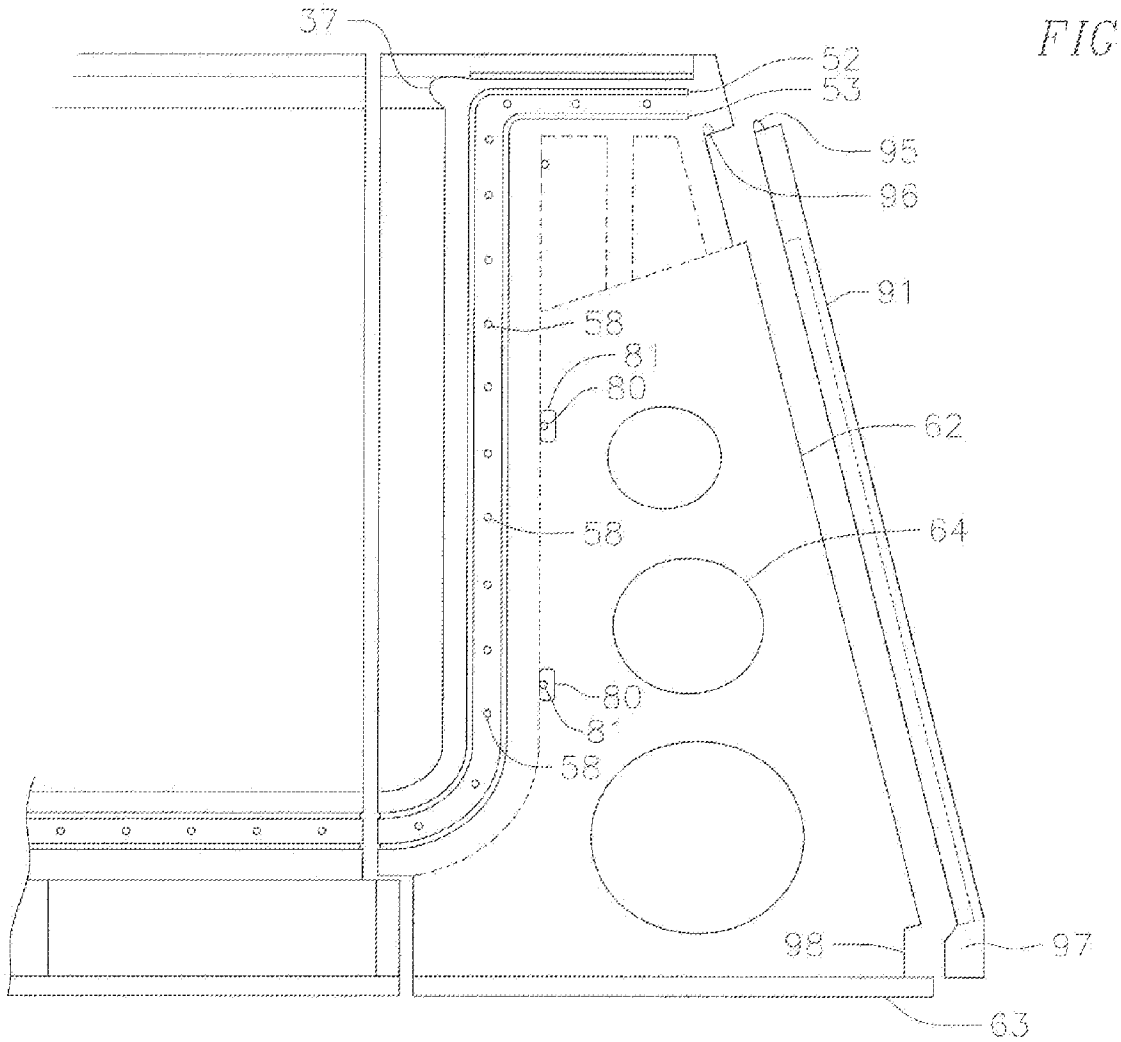
FIG. 6 is a side view a pool wall section and a skirt section according to one embodiment of the invention.

An elastomeric seal 54, 55, 56, 57 is seated within each channel and compressed by the applied force of a plurality of fasteners, e.g., bolts 43, nuts, 44, and washers 45. The bolts extend through holes 58 in each side panel. As can be seen in FIG. 6, the holes are located along an imaginary line that lies between, and is parallel to, adjacent grooves or channels, e.g., between channels w and x and channels y and z. Optionally, the material in the immediate vicinity of seine or all of the holes 58 is reinforced by a gusset or pair of gussets (not shown) on the non-mating face of each panel. The material near each hole 26 in the floor section(s) can be similarly reinforced.

The elastomeric seals are made of a durable, water-proof and resilient material suitable for forming a water-tight joint when compressed within a channel, similar to an O-ring or gasket. Examples of suitable materials include natural rubber, which can be crosslinked or uncrosslinked; elastomers and related copolymers; and similar materials. More specific examples include neoprene, nitrile rubber, and other elastomeric (co)polymers, which can be crosslinked or uncrosslinked.

The cross-sectional shape of the channels reflects the cross-sectional shape of the corresponding grooves that form the channels. In the embodiment shown, the grooves have semi-circular cross-sections, and the resulting channels are circular in cross-section. Alternatively, the grooves can have a square, rectangular, triangular, semi-elliptical, or some other cross-sectional shape. In general, the elastomeric seals are sized slightly larger than the channels. This facilitates the formation of a water-tight joint between adjacent floor and wall sections and adjacent wall sections when the seals are squeezed within the channels.

Figure 4:
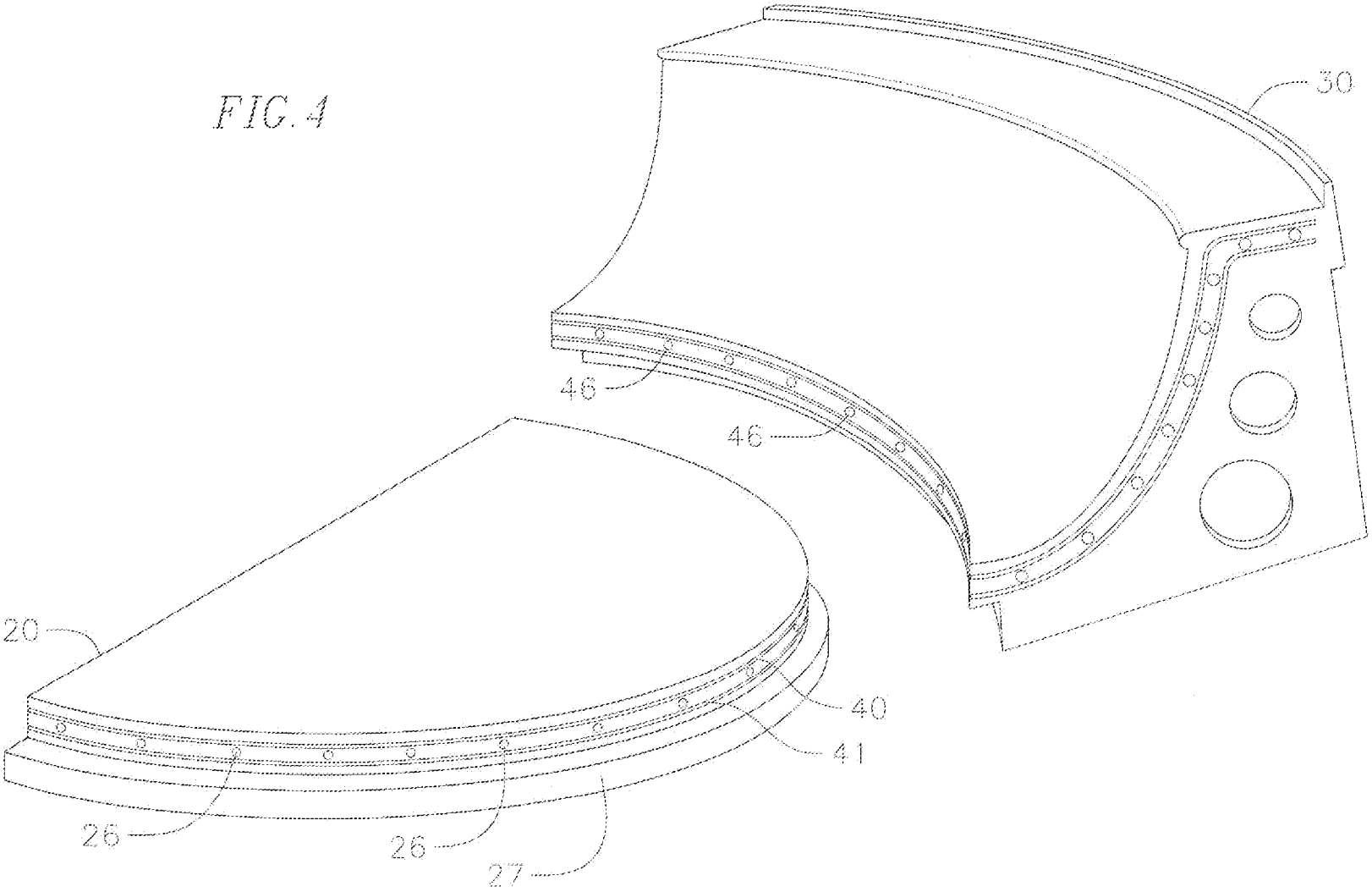
FIG. 4 is a perspective view of a pool wall section and a pool floor section according one embodiment of the invention.
Figure 5:
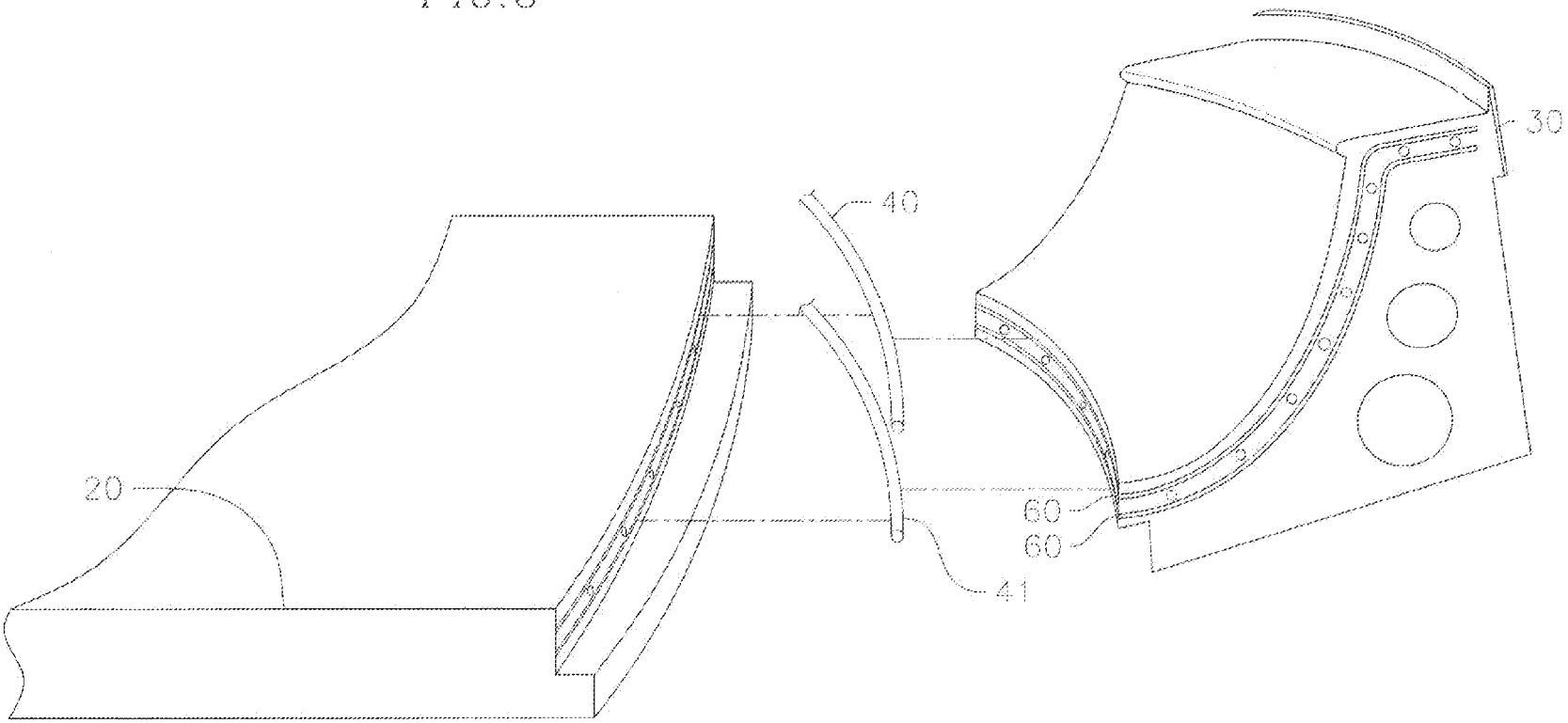
FIG. 5 is a perspective partially exploded view of a pool wall section adjacent to a pool floor section according to one embodiment of the invention, with a pair of elastomeric seals positioned to be placed within channels formed by complementary grooves between the sections.

As can be seen in FIGS. 2*e*, 4, and 5, the grooves 38, 39 in the face 36 of the lower portion of a wall section meet the grooves 52, 53 in each side panel at a 90 degree angle. Consequently, the channels formed between a given wall section and an adjacent floor section are formed at right angles to—or normal to—the channels formed between adjacent wall section side panels. Advantageously, each elastomeric seal that is seated in a channel formed between adjacent wall sections ends in a concave tip 60 so that it can conform closely to the cross-sectional shape of a seal 40, 41 seated in a channel formed between a wall section and a floor section. Alternatively, it is possible to stagger or offset the grooves formed in the wall section side panels relative to the grooves formed between wall and floor sections, so that they don't meet. In that case, the elastomeric seals seated in the channels formed between adjacent wall sections can simply end in a flat tip, perpendicular to the body of each seal.

As shown in FIGS. 1 and 2*b*, each wall section 30 includes at least one supporting buttress 62. In the embodiments shown in FIGS. 1 and 2, each wall section has three buttresses, 62*a*, 62*b*, and 62*c*. Two of these (62*a*; 62*b*) are extensions of—and integral with—the left and right side panels 32*a*, 32*b*. The third buttress 62*c* is located in the middle of the wall section and extends outwardly from the main panel 31. At the base of each buttress, a flange or foot 63 extends laterally from the buttress and provides additional stability. When two wall sections are side by side, a buttress from the first wall section abuts a buttress from the second wall section and thereby forms a common buttress that is thicker than each adjoining buttress individually. In one embodiment, the two shared buttress can be bolted together at one or more locations. To reduce the weight of the wall sections, cutouts 64 are formed in the side panels/buttresses. The number, shape, and location of the cutouts are selected to minimize stress concentration within the side panels/buttresses.

Figure 9:
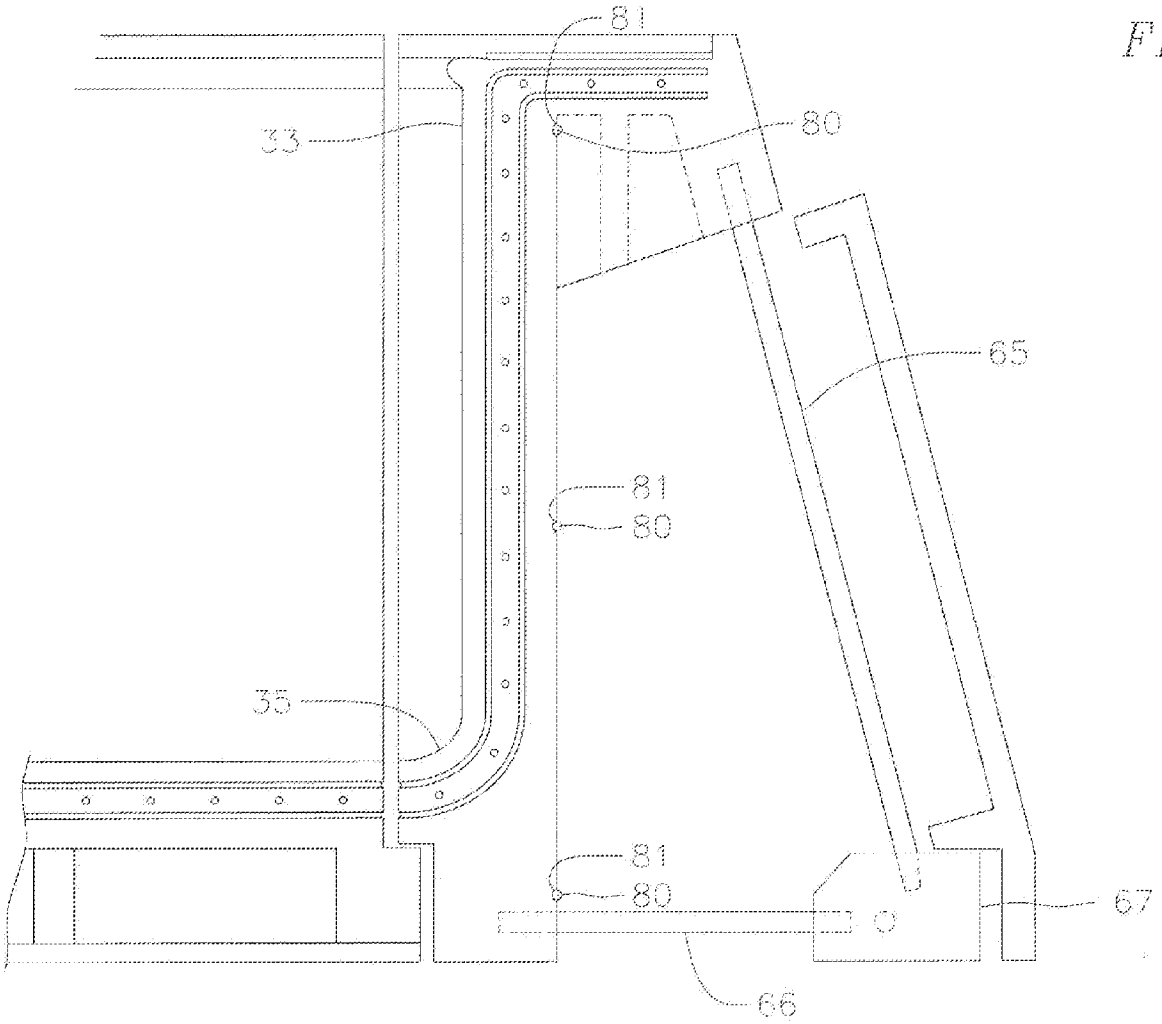
FIG. 9 is a side view similar to FIG. 6, showing another embodiment for joining a skirt section to a wall section.

In an alternate embodiment shown in FIG. 9 each buttress has a tubular construction, in which two or more tubes 65, 66 link the upper portion 33 of a wall section main panel 31 to a foot 67 spaced distally from and behind the lower portion 35 of the main panel of the wall section. The tubes are insertable into mating holes in the main panel, foot, and/or side panels and can be secured therein with a friction fit, threaded connections, an adhesive, or other means of connection.

Figure 13:
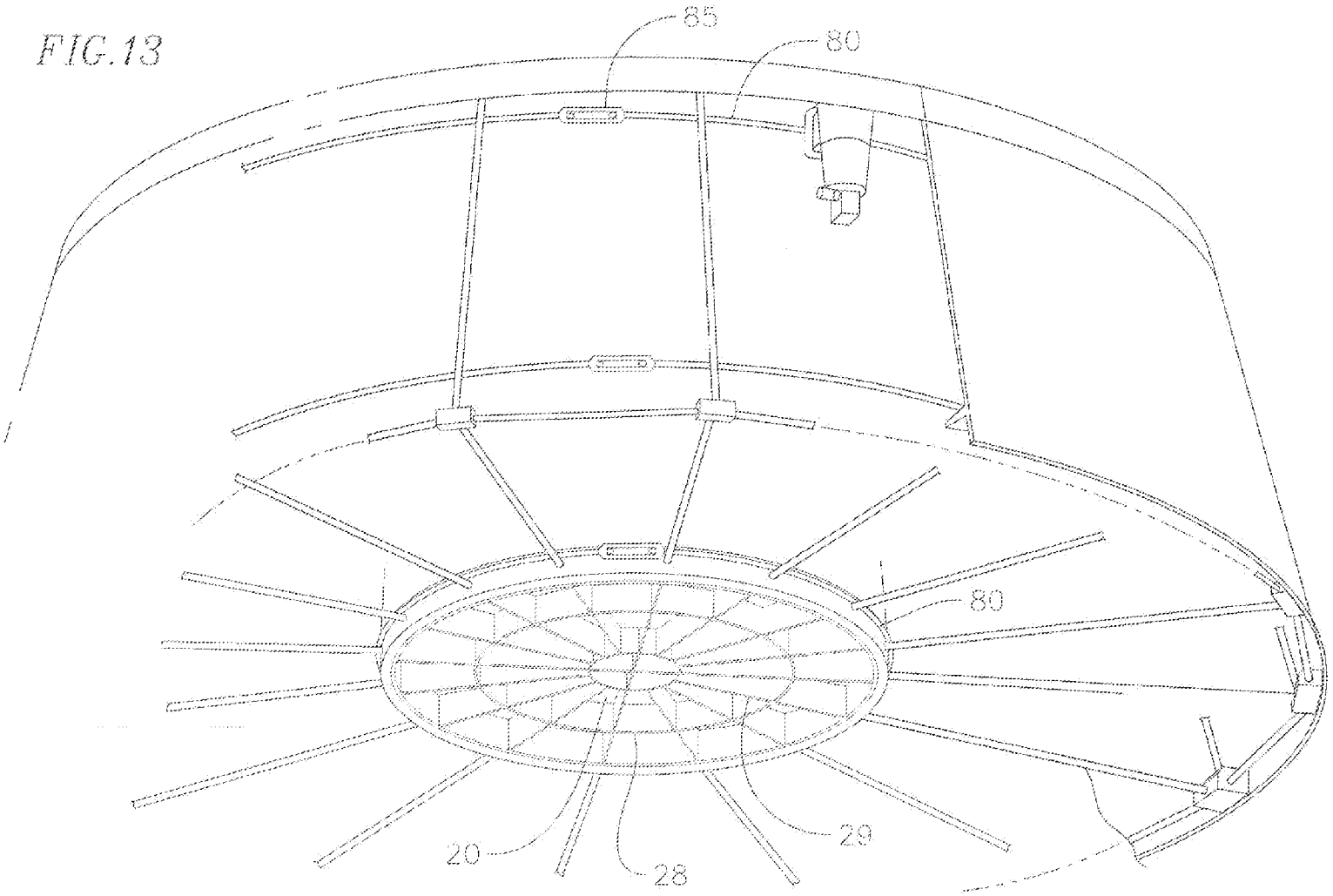
FIG. 13 is a perspective view of the embodiment shown in FIG. 12, showing additional detail of the floor support members.

To enhance the overall structural integrity of the swimming pool, a plurality of high-strength cables 80 extend around the pool. In FIGS. 1, 6, and 13, three cables are provided, located in the upper, middle, and lower portions of the pool, respectively. The pressure on the pool walls is greatest at the bottom of the pool, and cables are preferentially placed at least at the bottom third to bottom half of the height of the pool. Together with the wall section buttresses, the cables resist the outward pressure of water when the pool is filled with water.

The cables—and the walls of the pool—are held in tension by tightening a plurality of turnbuckles 85 placed at various positions around the perimeter of the wall sections, distally located behind the wall sections' main panels (see FIGS. 1 and 13). A plurality of slots or holes 81 are formed in the side panels of the wall sections (and in the middle buttress 62*c*, if present) and provide a path for the cables 80 to encircle the pool. (See FIGS. 1, 2*b*, and 9.) Optionally, a bushing (not shown) in some or all of the holes 82 provides additional reinforcement. In one embodiment, ribs not shown) extending from the outer (distal) side of the main panel can be provided to match the curvature of the cables, particularly near the turnbuckles, and provide additional structural support.

In an alternate embodiment (not shown), metal straps, similar to the kind used to secure a house water heater, are used in lieu of cables. Suitable hardware (e.g., bolts and nuts) fasten the two ends of each strap together. The cables or straps can be made of steel or another suitably strong material. To resist weathering, the cables can be galvanized, made of stainless steel, wrapped in vinyl, or protected in some other manner.

A decorative skirt 90 wraps around the circumference of the pool and hides the buttresses and the back of the wall sections. The skirt is comprised of a plurality of skirt sections 91, each having a top end 92 bottom end 93, and two sides 94*a*, 94*b*. In one embodiment, shown in FIG. 6, a tab 95 in the top end of each skirt section 91 engages with a corresponding notch 96 in an adjacent wall section or pair of adjacent wall sections, e.g., a notch located in the upper portion 33 of the main panel 31 of a wall section, and/or in an upper portion of one or both of the wall section buttresses 62. Similarly, an inwardly directed projection or foot 97 in the bottom end 93 of each skirt section engages with a corresponding slot or recess 98 in the back of either or both buttresses of an adjacent wall section.

Figure 8:
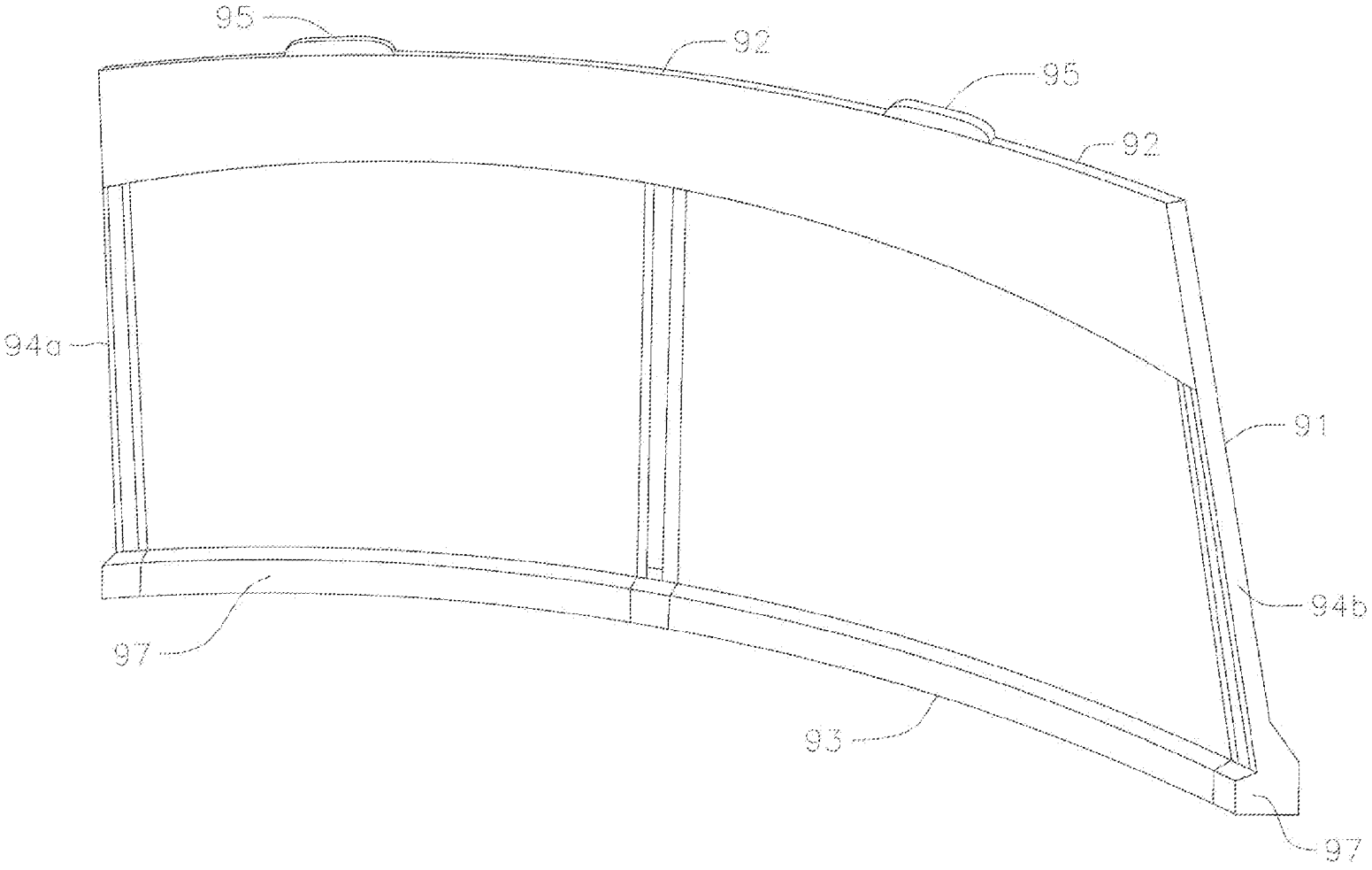
FIG. 8 is a perspective view of the interior side of a skirt section according to one embodiment of the invention.

FIG. 8 depicts the interior (pool facing) side of a typical skirt section, with tabs 95 located along the top of the skirt section and a foot 97 running along the bottom end of the skirt section. An alternative embodiment for securing a skirt section to a wall section is shown in FIG. 9. In this case, the skirt section 91 fits snuggly into place with a simple friction it with one or more wall sections. Optionally, each skirt section can then be secured with one or more fasteners, e.g., stainless steel screws, bolts, etc.

Figure 14:
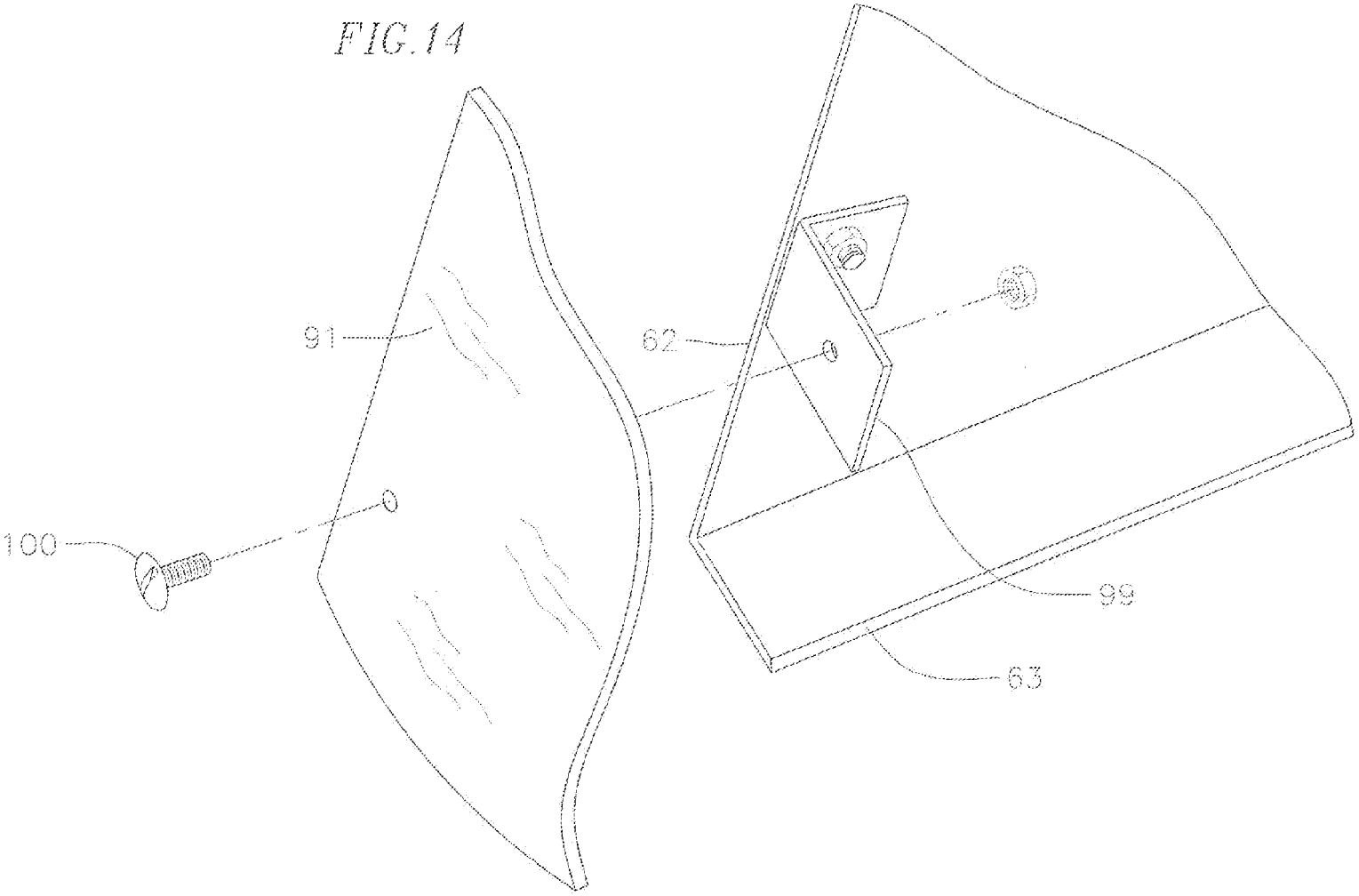
FIG. 14 is perspective, exploded view of a skirt and a wall section buttress, with skirt mounting hardware, according to one embodiment of the invention.

In an alternate embodiment shown in FIG. 14, the skirt sections 91 have neither tabs nor slots, but are secured to the wall sections using skirt mounting hardware, e.g., a plurality of flanges 99 and fasteners 100. The flanges can be attached to the buttresses, wall section side panels, and/or foot to provide points of attachment for mounting the skirt sections.

Figure 10:
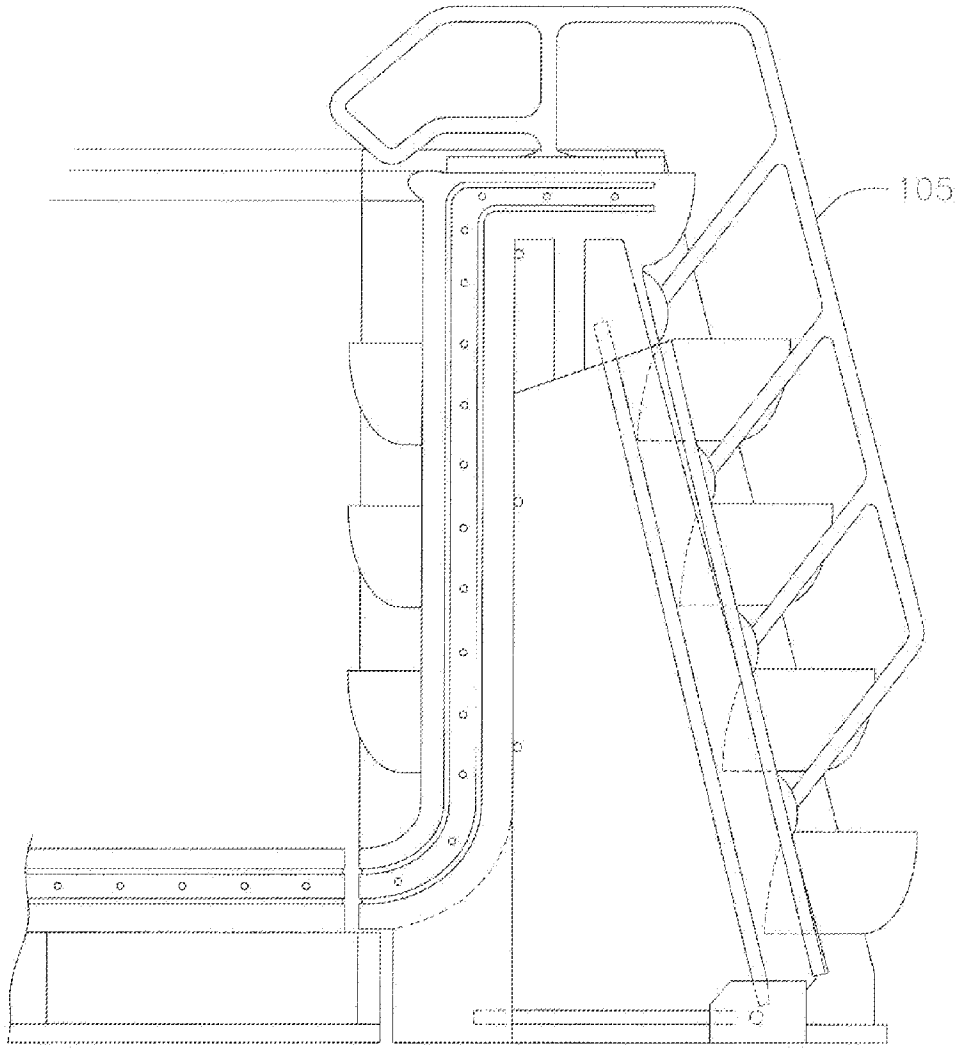
FIG. 10 is a side view similar to FIG. 6, showing, a wall section with a ladder according to one embodiment of the invention.
Figure 11:
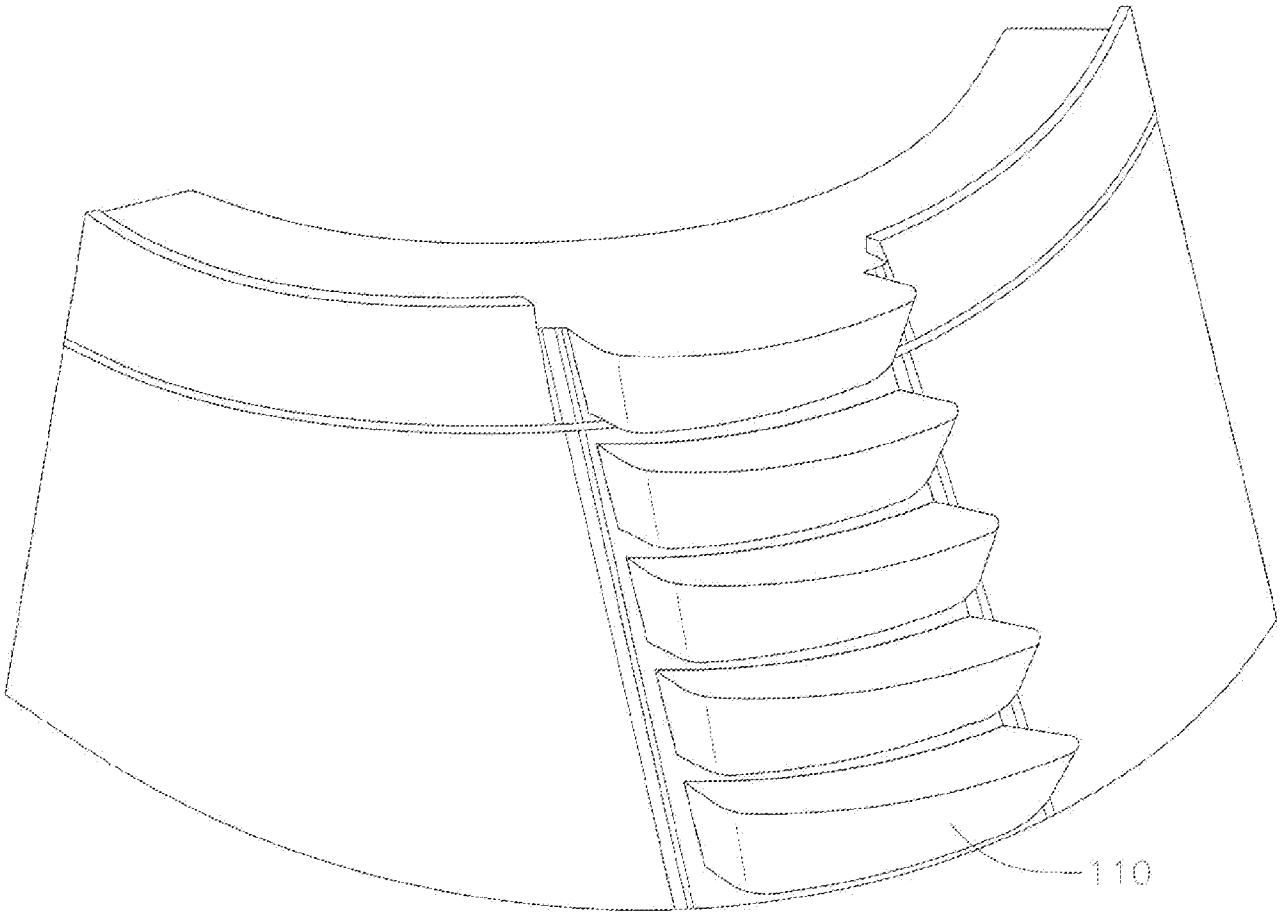
FIG. 11 is a schematic view of a skirt section having steps formed therein according to one embodiment of the invention.
Figure 12:
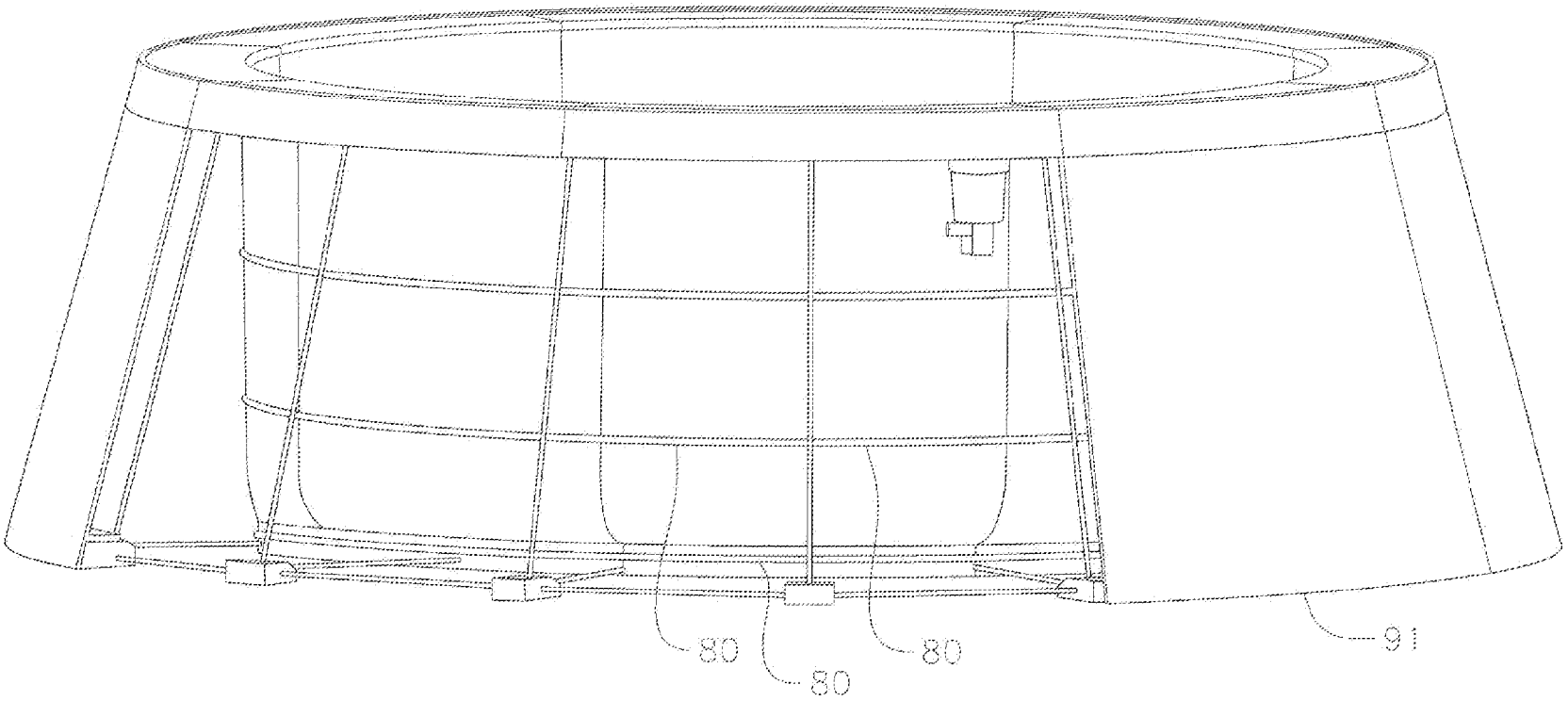
FIG. 12 is a perspective, view of an assembled pool according to one embodiment of the invention, with two skirt sections removed.

The skirt 90 provides the pool with an aesthetically desirable appearance, as the outer surface car be formed to look like sand, rock, brick, wood, or any other texture or motif. In addition, the skirt imparts additional structural integrity to the pool, as the multiple skirt sections effectively lock into place all the way around the pool. Additional features, such as a ladder 105 (FIG. 10), steps 110 (FIG. 11), waterfall or slide, etc., can be formed in or mounted to one or more of the skirt sections. Alternatively, such features can be integral with or attached to one or more wall sections.

Other features common to swimming pools and spas, such as openings for skimmers, ports for air jets ports for pool vacuum systems, drains, pumps, filters, lights speakers, waterfalls, slides, waterfalls, etc. can be included by forming such features into one or more of the floor, wall, and/or skirt sections during manufacture, or by adding the feature(s) during assembly, with a suitable water-tight seal being provided where appropriate. Some components are sufficiently small that they can be located within the space between the back side of one or more wall sections and the adjoining skirt section(s).

FIGS. 15*a*-15*h* depicts an alternate embodiment of the invention, similar in most respects to the pool depicted in FIG. 1, but having a subfloor under the primary floor and a panel support behind the main panel of each wall section. The pool 10 has a central floor section 20 surrounded in a water-tight fashion by eight curved wall sections 30. The central floor section includes a primary floor 11 and a subfloor 12, the latter having a "waffle-like" configuration with a series of crests 13 and troughs 14 (see FIGS. 15*g* and 15*h*). A sidewall 15 extends from the outer perimeter of the primary floor, and the primary floor fits over the subfloor 12 and encompasses it like a cap. (The outer surface of the sidewall is comparable to the side 23 of the floor section shown in FIG. 3, and is labeled as such in FIG. 15*h*.) The subfloor's crest-and-trough structure provides sufficient strength to withstand the pressure of water bearing down on the floor of the pool, while the primary floor has a substantially flat run surface.

In the sidewall 15 of the primary floor 11 are a pair of grooves 24, 25. Together with corresponding pairs of grooves in the face 36 found at the lower portion of each wall section 30, the grooves define two channels that extend completely around the primary floor 11. An elastomeric seal 40, 41 sits in each channel, and the seals allow the wall sections 30 to form water-tight joints with the central floor section, essentially as described above. The sections are fastened together by a plurality of bolts (no shown) that extend through holes 26 in the primary floor's sidewall 15 and corresponding holes in the inwardly directed face 36 of each wall section, essentially as described above. The bolts are secured in place with washers and nuts (not shown).

Figure 15A:
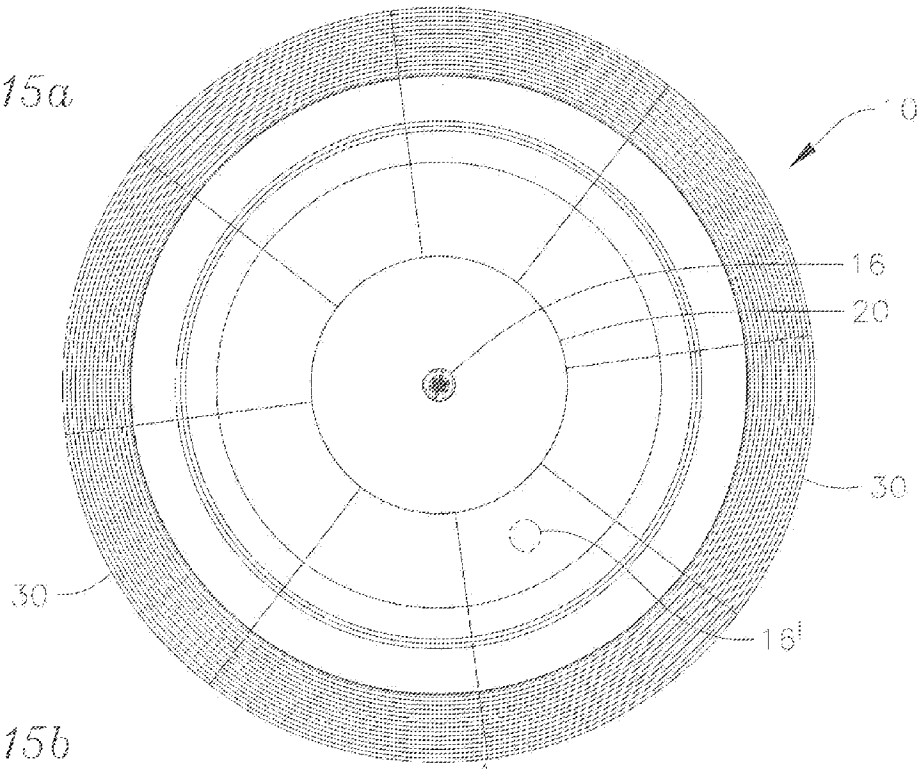
FIG. 15*a* is top plan view of a circular swimming pool according to another embodiment of the invention.
Figure 15B:
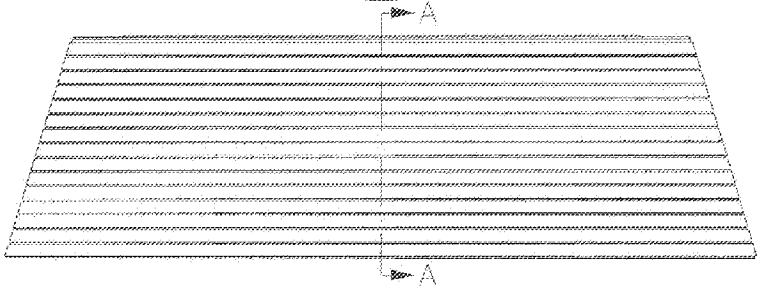
FIG. 15*b* is a side devotional view of the swimming pool shown in FIG. 15*a;*
Figure 15C:
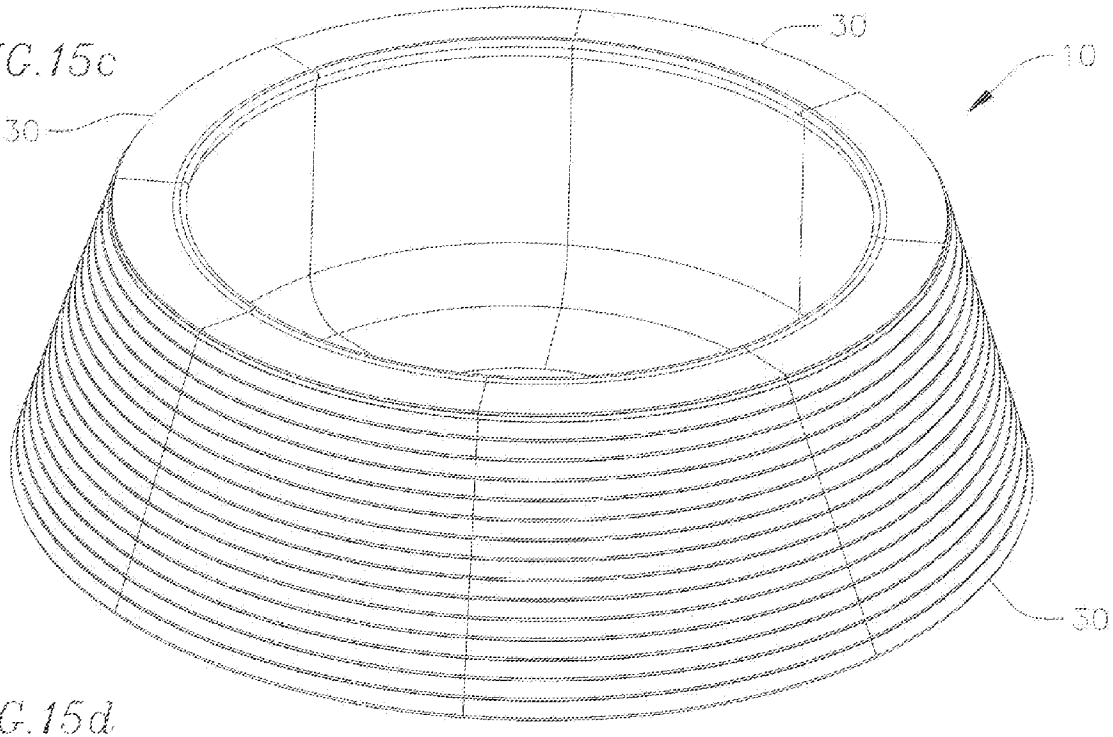
FIG. 15*c* is a perspective view of the swimming pool shown in FIG. 15*a;*
Figure 15D:
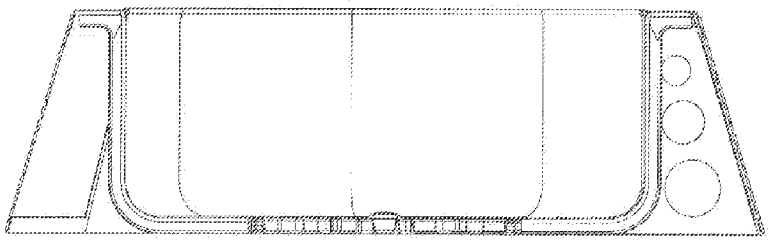
FIG. 15*d* is a section view swimming pool shown in FIG. 15*b*, taken along line A-A.
Figure 15G:
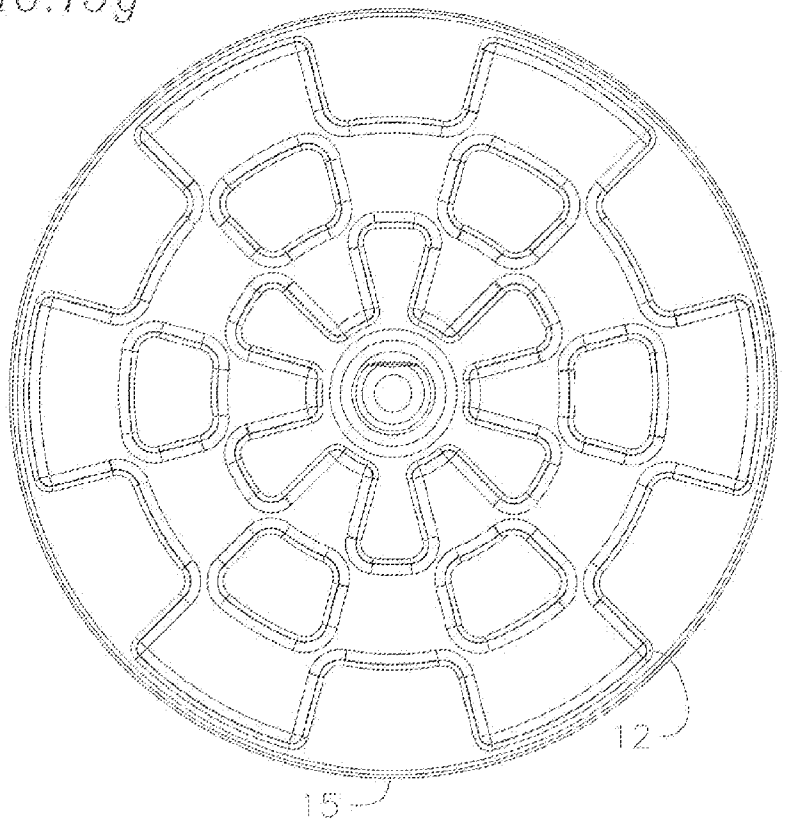
FIG. 15*g* is a bottom view of the central floor section shown in FIG. 15*e;*
Figure 15E:
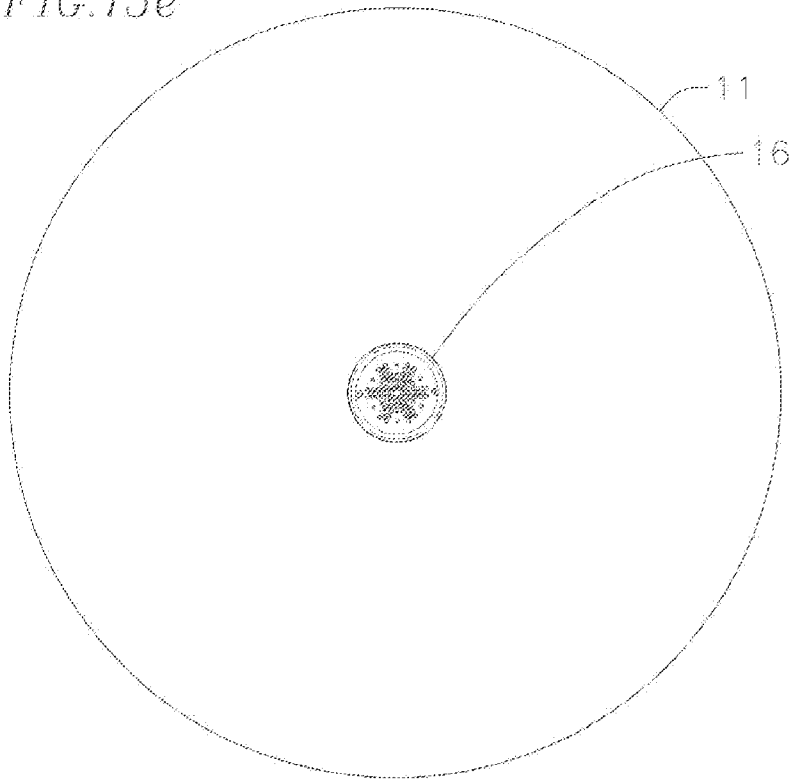
FIG. 15*e* is a top view of the central floor section of the swimming pool shown in FIG. 15*a;*
Figure 15F:
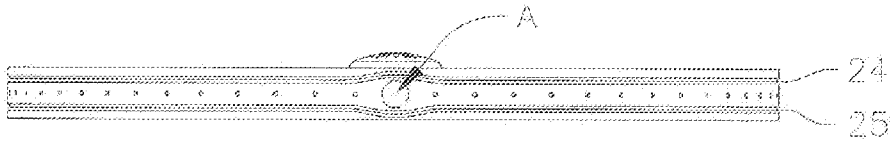
FIG. 15*f* is a side view of the central floor section shown in FIG. 15*e;*
Figure 15H:
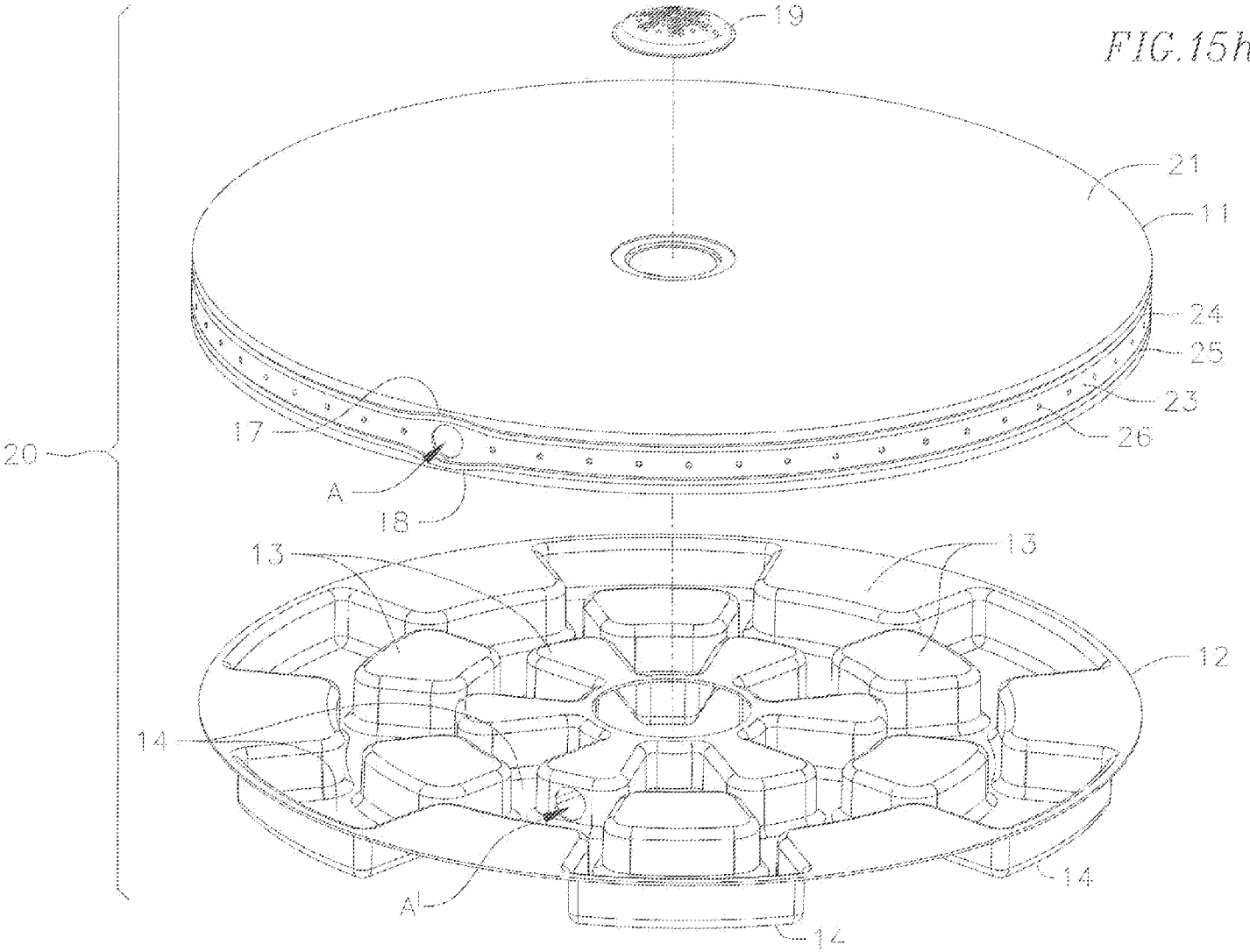
FIG. 15*h* is an exploded perspective view of the central floor section shown in FIGS. 15*e*-15*g;*
Figures 16A, 16B, 16C, 16D, 16E:
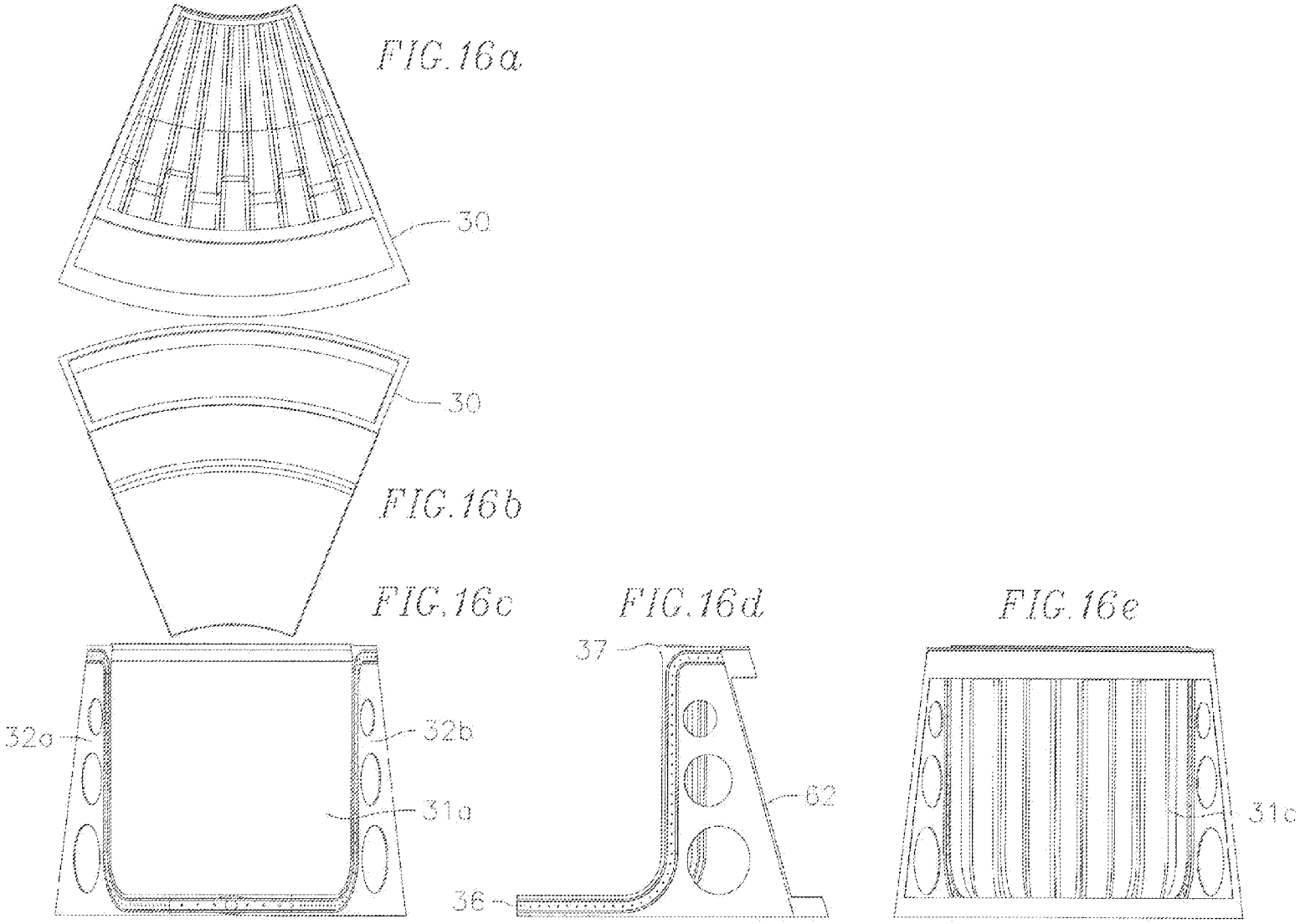
FIG. 16*a* is a bottom plan view of a wall section of the swimming pool shown in FIG. 15*a;*
FIG. 16*b* is a top plan view of the wall section shown in FIG. 16*a;*
FIG. 16*c* is a front devotional view of the wall section shown in FIG. 16*a;*
FIG. 16*d* is a side elevational view of the wall section pool shown in FIG. 16*a;*
FIG. 16*e* is a rear devotional view of the wall section shown in FIG. 16*a*, with the outer skirt removed.
Figure 16F:
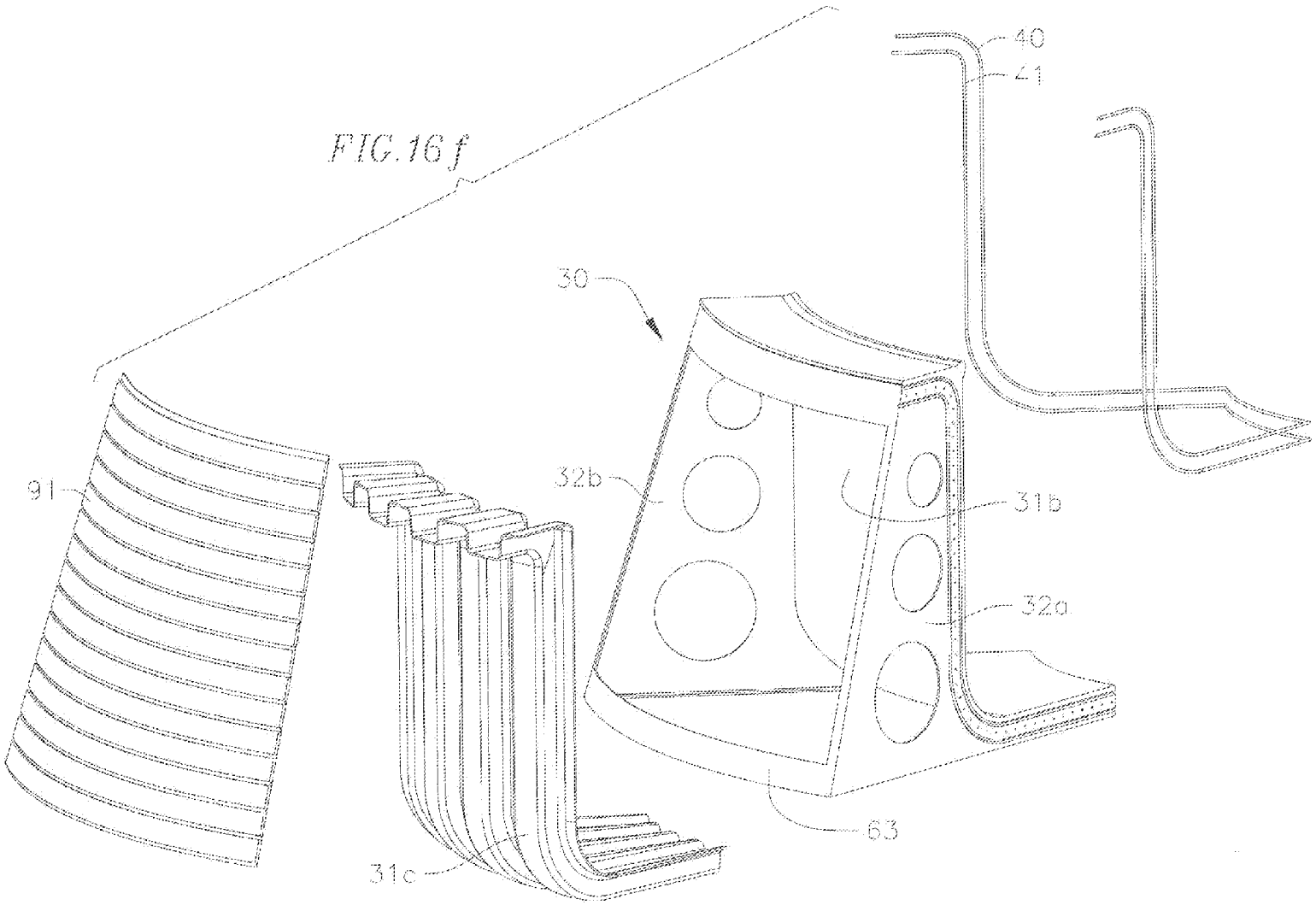
FIG. 16*f* is an exploded perspective view of the wall section shown in FIGS. 16*a*-16*e*, with the skirt visible.
Figure 17A:
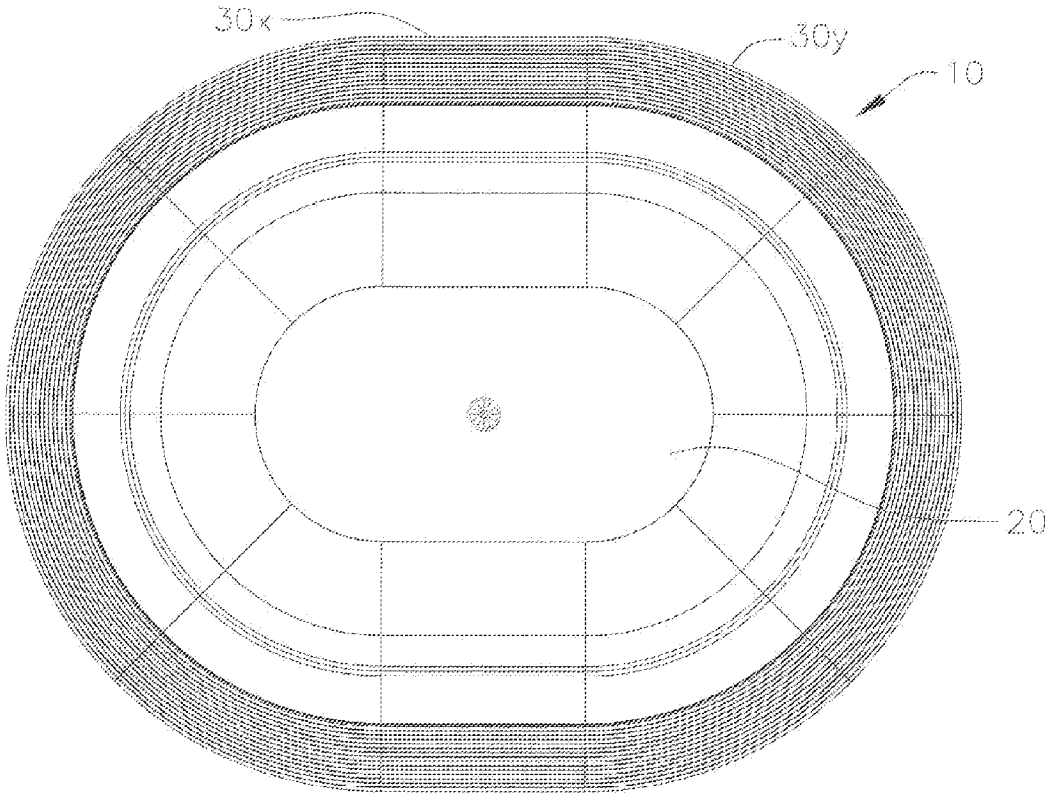
FIG. 17*a* is top plan view of an oval swimming pool according to another embodiment of the invention.
Figure 17B:
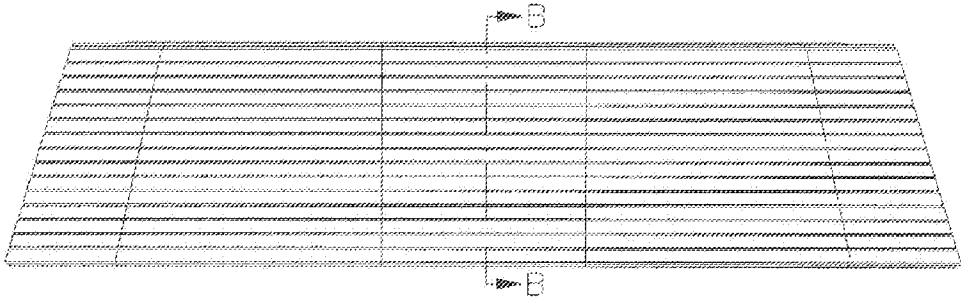
FIG. 17*b* is a side elevational view of the swimming pool shown in FIG. 17*a;*
Figure 17C:
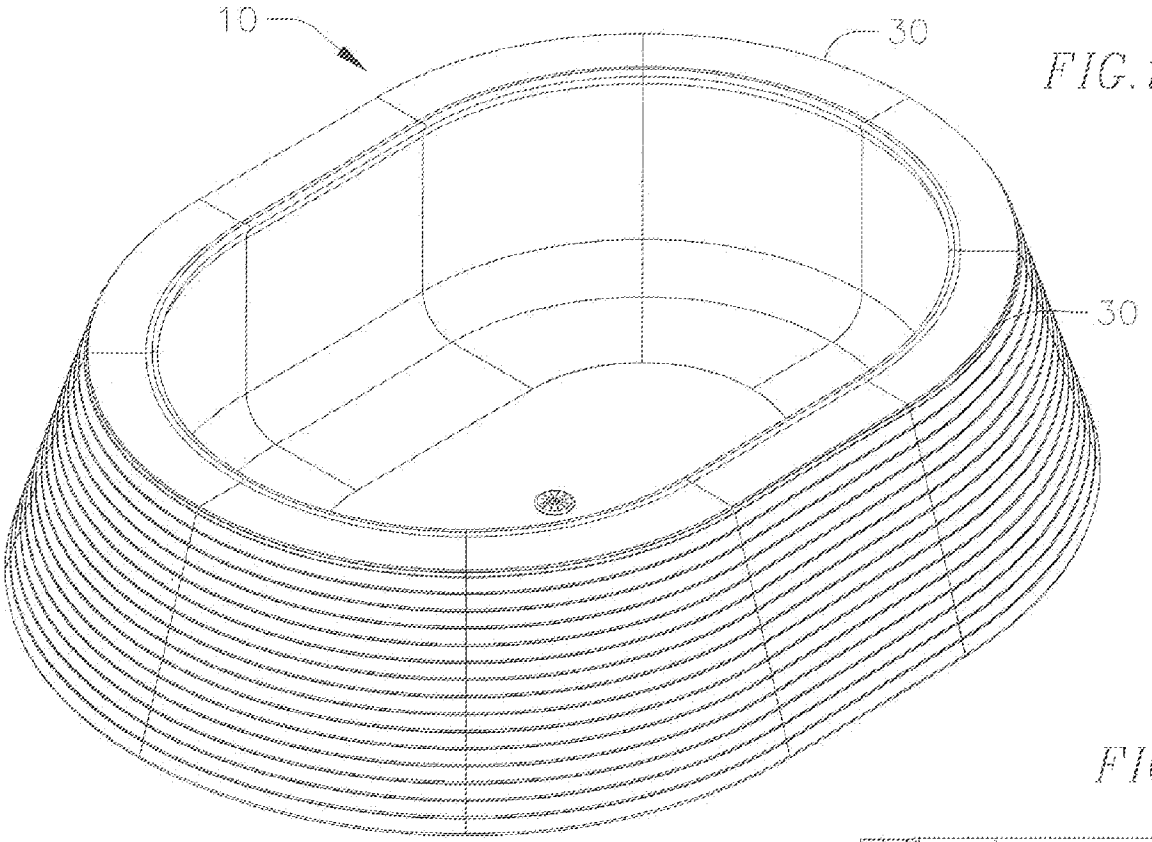
FIG. 17*c* is a perspective view of the swimming pool shown in FIG. 17*a;*
Figure 17D:
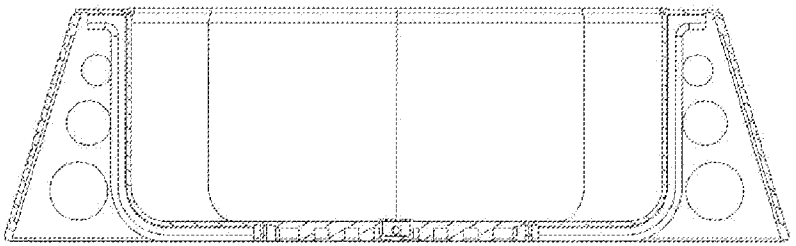
FIG. 17*d* is a sectional view of the swimming pool shown in FIG. 17*b*, taken along line B-B.
Figure 17E:
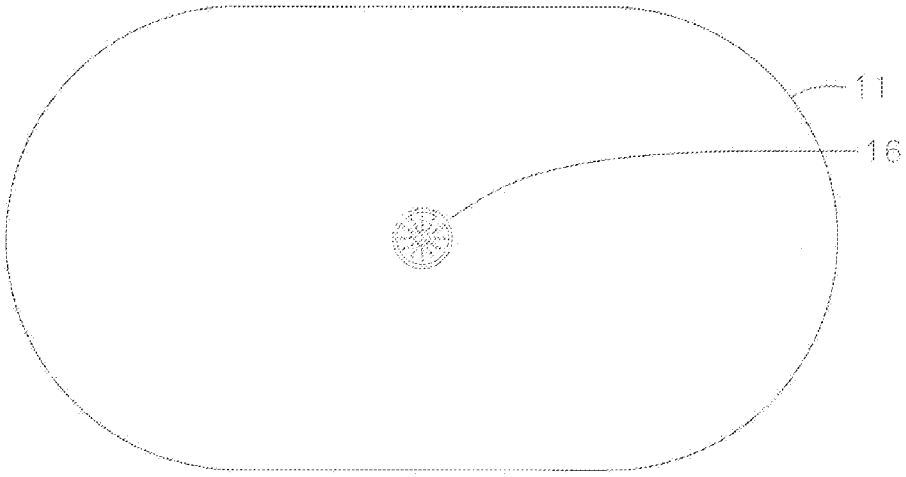
FIG. 17*e* is a lop view of the central floor section of the swimming pool shown in FIG. 17*a;*
Figure 17F:
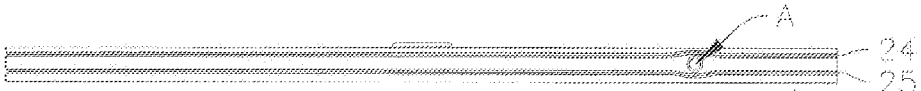
FIG. 17*f* is a side view of the central floor section shown in FIG. 17*e;*
Figure 17G:
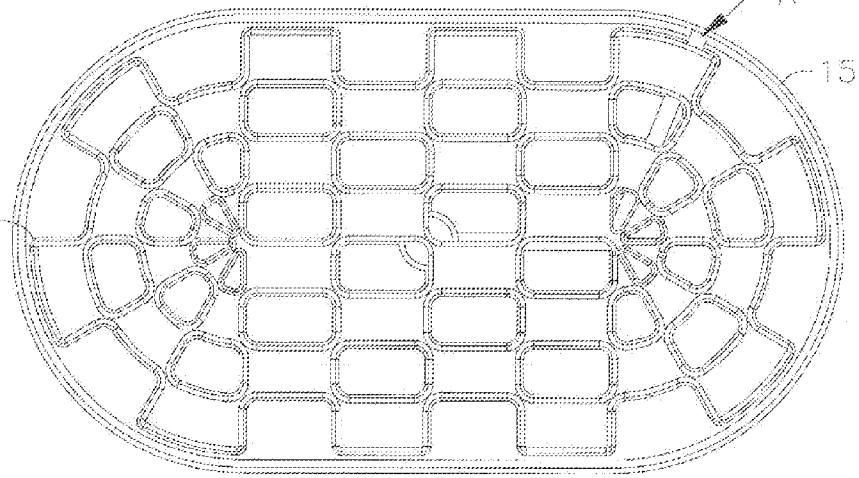
FIG. 17*g* is a bottom view of the central floor section shown in FIG. 17*e;*
Figure 17H:
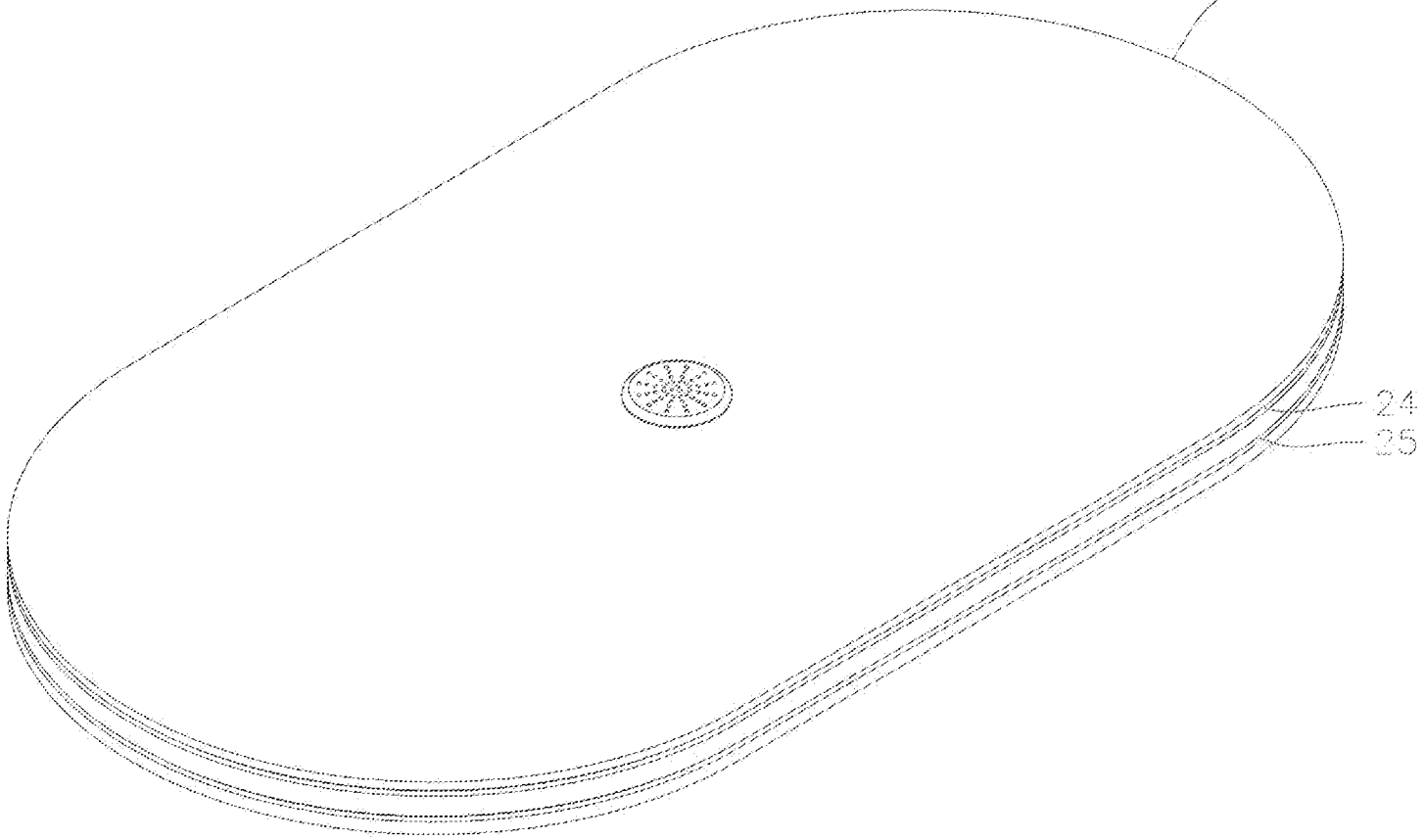
FIG. 17*h* is a perspective view of the central floor section shown in FIGS. 17*e* and 17*f;*
Figure 18A:
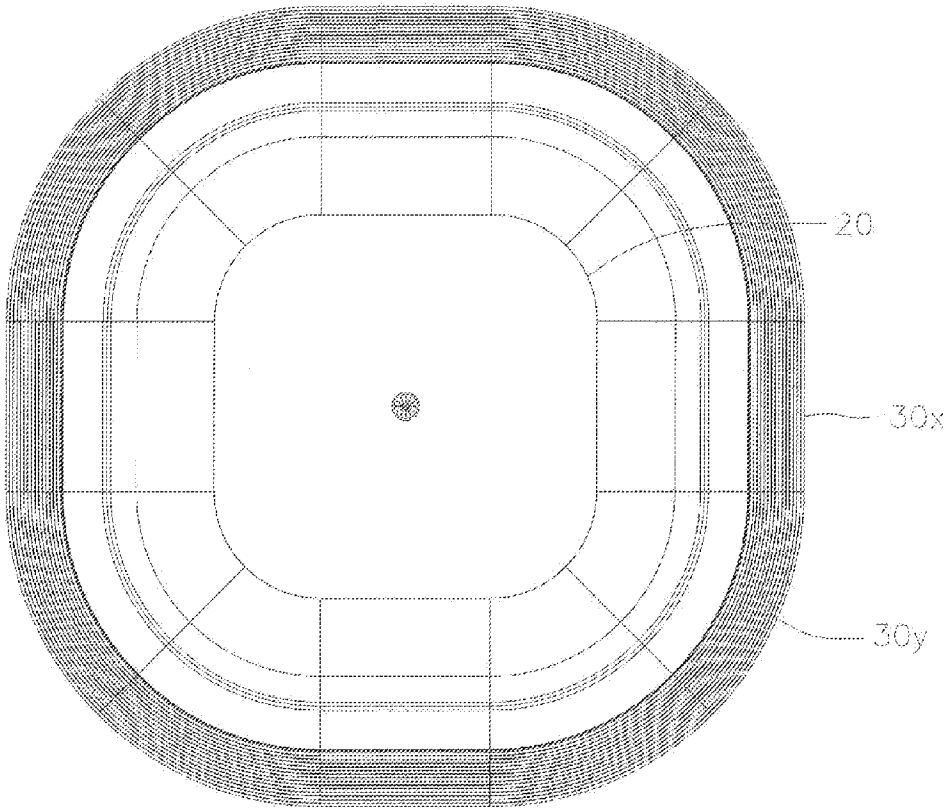
FIG. 18*a* is top plan view of a square swimming pool according to another embodiment of the invention.
Figure 18B:
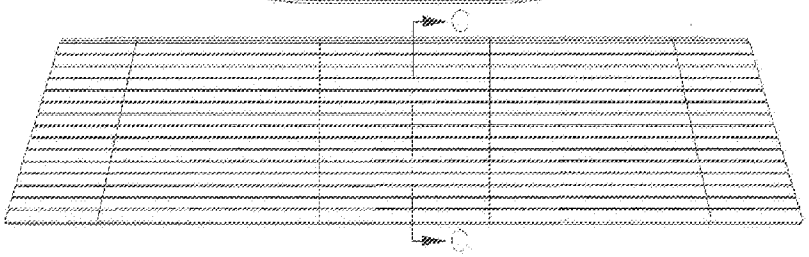
FIG. 18*b* is a side devotional view of the swimming pool shown in FIG. 18*a;*
Figure 18C:
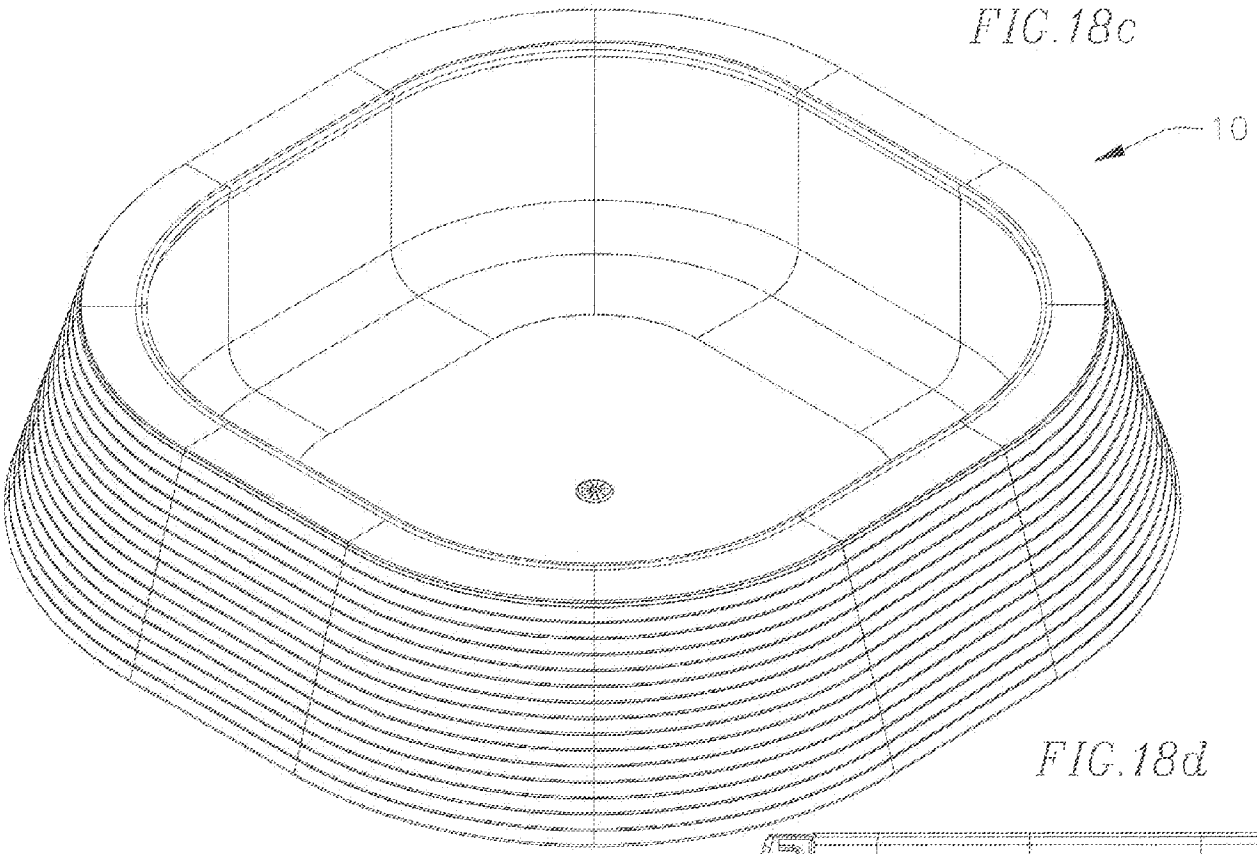
FIG. 18*c* is a perspective view of the swimming pool shown in FIG. 18*a;*
Figure 18D:
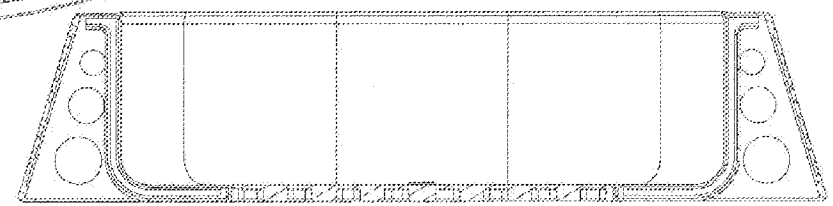
FIG. 18*d* is a sectional view of the swimming pool shown in FIG. 18*b*, taken along line C-C.
Figure 18G:
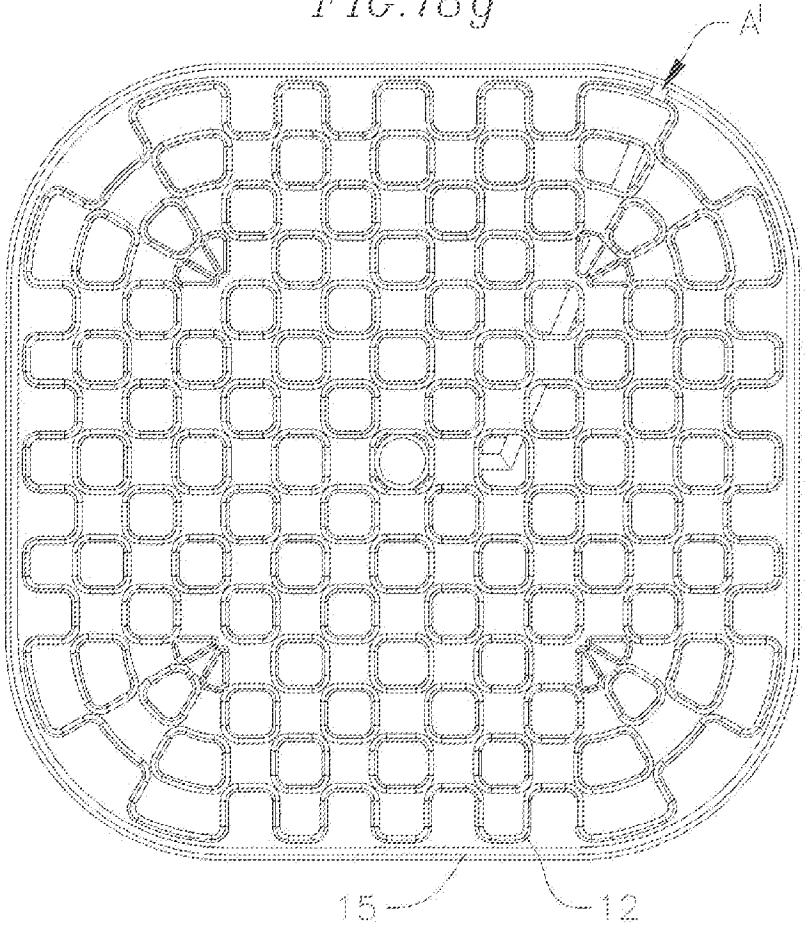
FIG. 18*g* is a bottom view of the central floor section shown in FIG. 18*e;*
Figure 18E:
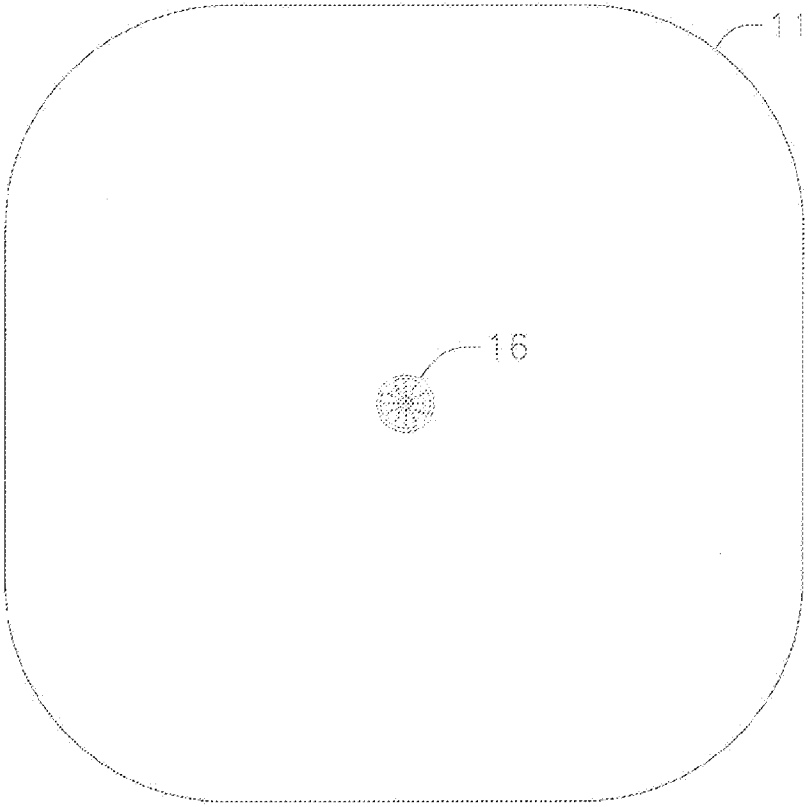
FIG. 18*e* is a top view of the central floor section of the swimming pool shown in FIG. 18*a;*
Figure 18F:
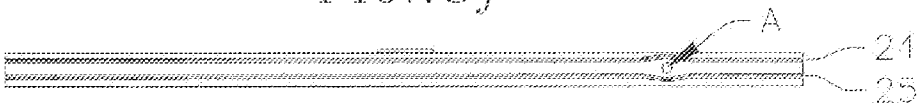
FIG. 18*f* is a side view of the central floor section shown in FIG. 18*e;*
Figure 18H:
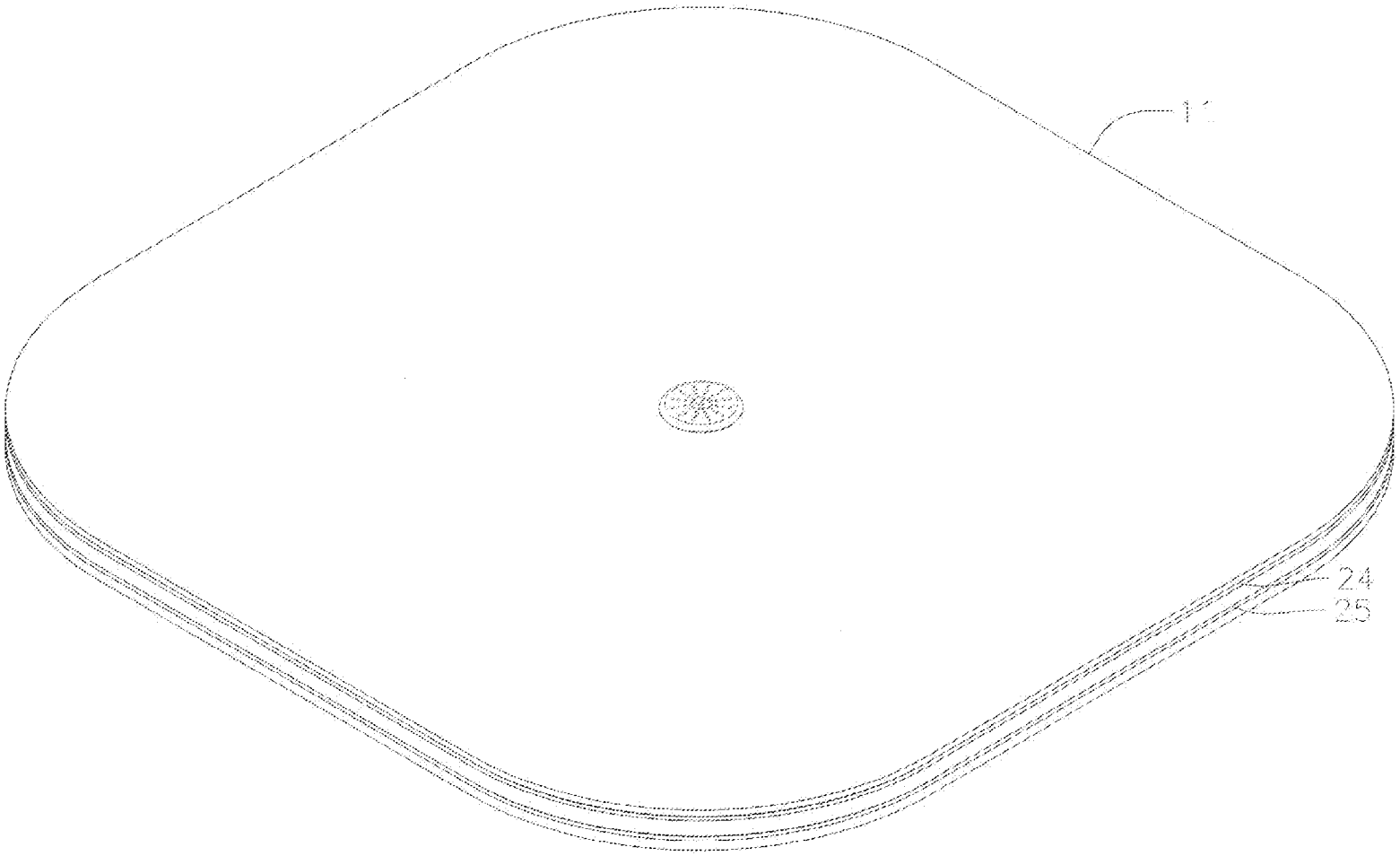
FIG. 18*h* is a perspective view of the central floor section shown in FIGS. 18*e* and 18*f;*

A drain cap 16 covers a drain opening in the center of the floor and is secured thereto with as threaded connection, O-ring(s), gasket(s), or other water-tight connection. The drain cover provides access to a drain passage that extends from as point A in the subfloor to another point A' in the sidewall 15 at the primary floor. A drain pipe (not shown) may be seated in the passage. As shown in FIG. 15*f*, the grooves 24, 25 in the sidewall 15 of the primary hour include a slight jog or inflection (17 and 18, respectively) in the area near the opening A'. This permits a larger diameter drain pipe to extend through the space between the two grooves. Alternatively, the pool drain is not centrally located but, instead, is located in the lower portion 35 of one of the wall sections 30. This is shown in FIG. 15*a*, where the dotted circle 16' denotes the alternate location. In this embodiment, the drainage conduit need only extends under a single wall section, and not under the central floor section 20.

FIGS. 16*a*-16*f* illustrate another feature of the alternate embodiment; a panel support 31*c*, which is attached, to or integral with the back side of each wall section 30. As previously described, a typical wall section 30 includes a main panel 31 and two side panels 32*a*, 32*b*. The side panels extend outwardly away from the interior of the pool and form buttresses 62. In FIGS. 16*a*-16*h*, the buttresses 62 are linked together at their base by a foot 63. The main panel 31 of each wall section has a front (pool facing) side 31*a* and a back side 31*b*. Attached to (or integral with) the back side 31*b* of the main panel 31 is a panel support 31*c*. In the embodiment shown in FIG. 16, the panel support 31*c* has a corrugated structure that strengthens the wall section. Adjacent wall sections 30 are joined together as previously described, and as depicted, for example, in FIG. 7. A skirt 90 made of multiple skirt sections 91 attaches to the back of the wall section as previously described.

The invention has primarily been characterized with a reference to a circular swimming pool or spa, with a single circular floor section. However, other designs and uses are also contemplated and within the scope of the invention. For example, an oval swimming pool is shown in FIGS. 17*a*-17*h*, with components essentially identical to those described above, but with an oval primary floor 11 that fits over a subfloor 12 having an oval footprint. The pool 10 includes two "straight" wall sections 30*x* and eight "curved" wall sections 30*y*. The floor and wall sections are constructed and joined together in substantially the same manner as they are in the circular swimming pool shown in FIGS. 15 and 16.

Similarly, FIGS. 18*a*-18*h* depict a "square" swimming pool, made of a substantially square floor section 20 (though having rounded corners), four straight wall sections 30*x*, and eight curved wall sections 30*y*. The floor section 20 includes a substantially square primary floor 11 and a subfloor 12 having a substantially square footprint. The floor and wall sections are constructed and joined together in substantially the same manner as previously described.

Figure 19A:
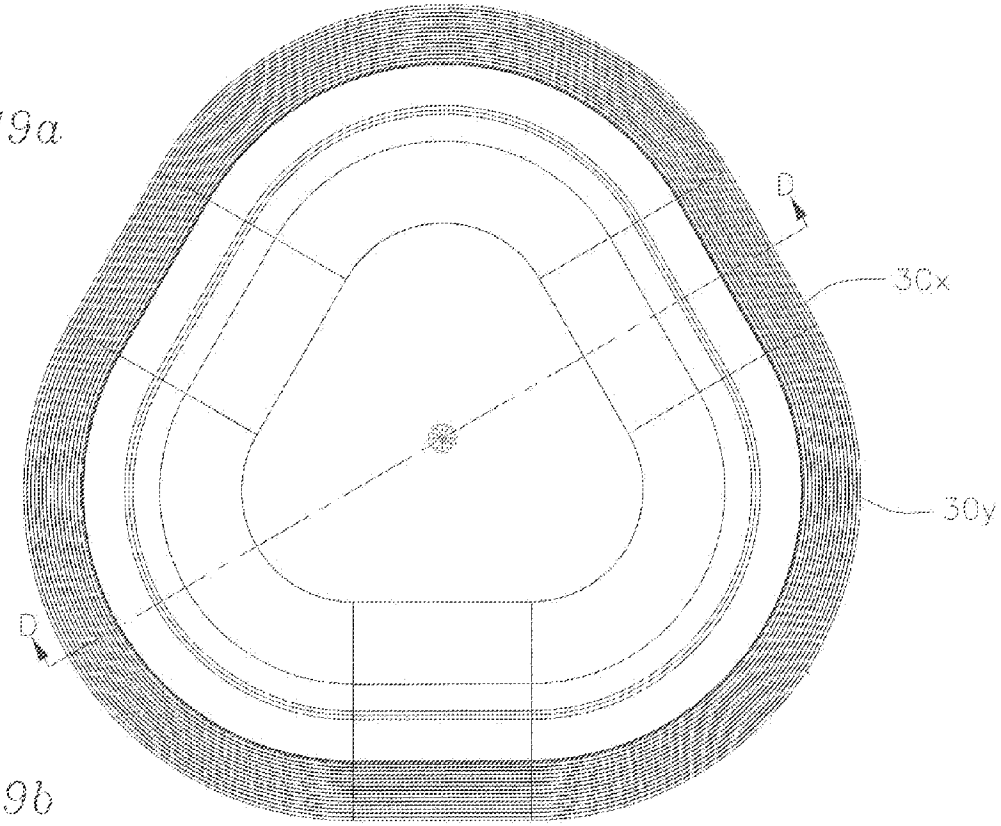
FIG. 19*a* is top plan view of a triangular swimming pool according to another embodiment of the invention.
Figure 19B:
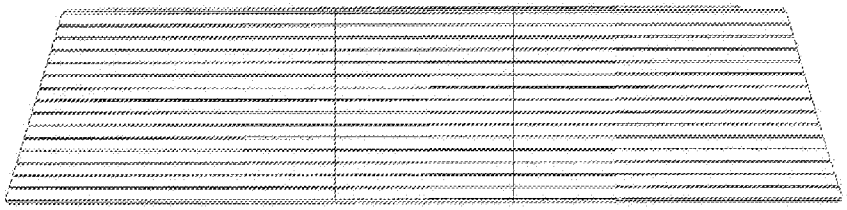
FIG. 19*b* is a side devotional view of the swimming pool shown in FIG. 19*a;*
Figure 19C:
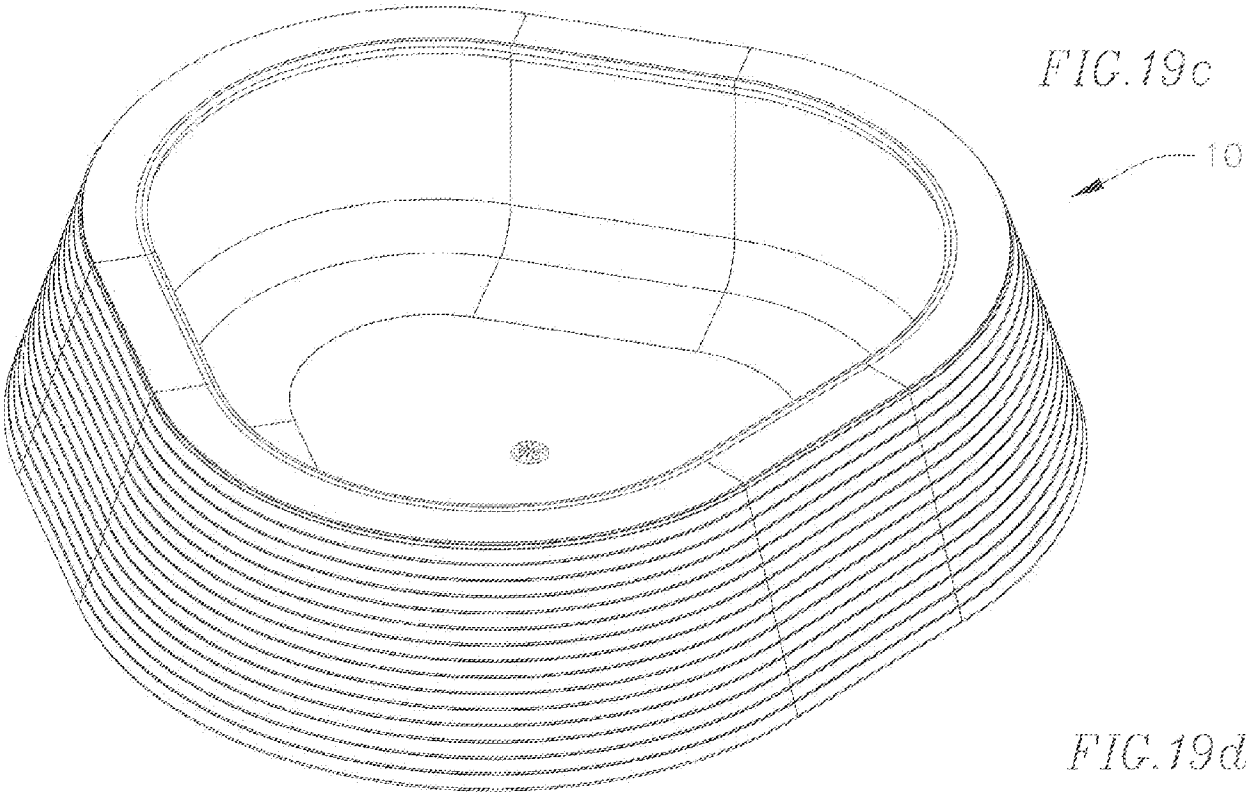
FIG. 19*c* is a perspective view of the swimming pool shown in FIG. 19*a;*
Figure 19D:
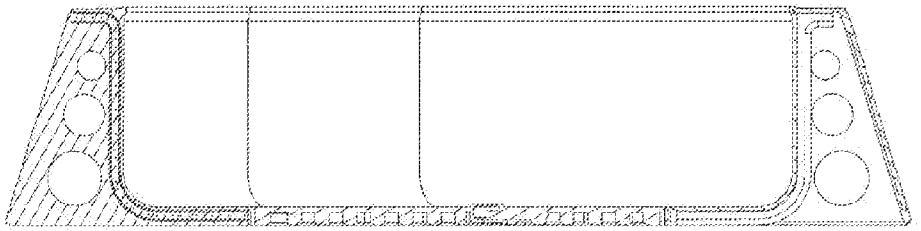
FIG. 19*d* is a sectional view of the swimming pool shown in FIG. 19*a*, taken along line D-D.
Figure 19G:
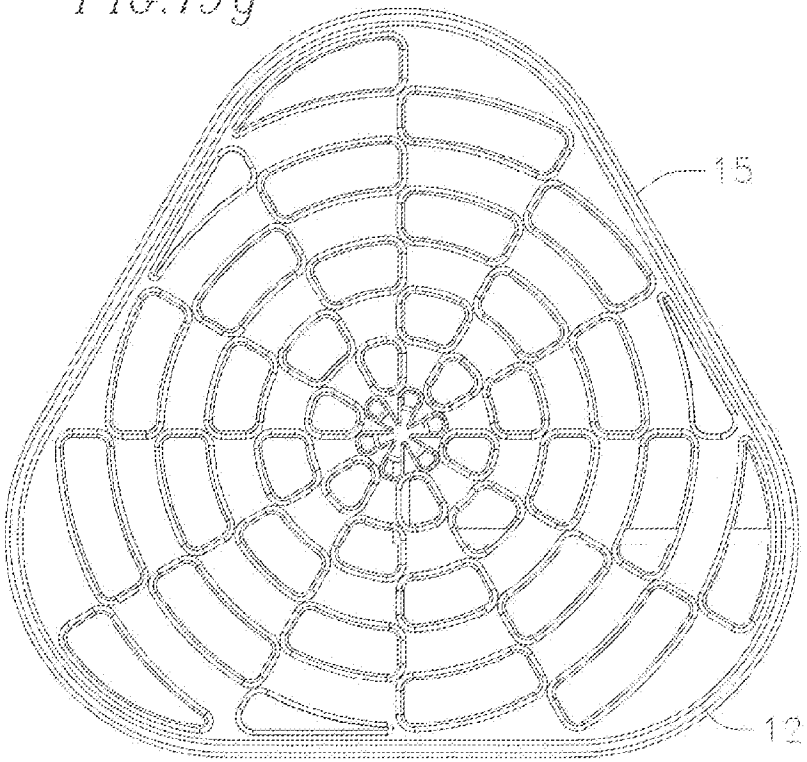
FIG. 19*g* is a bottom view of the central floor section shown in FIG. 19*e;*
Figure 19E:
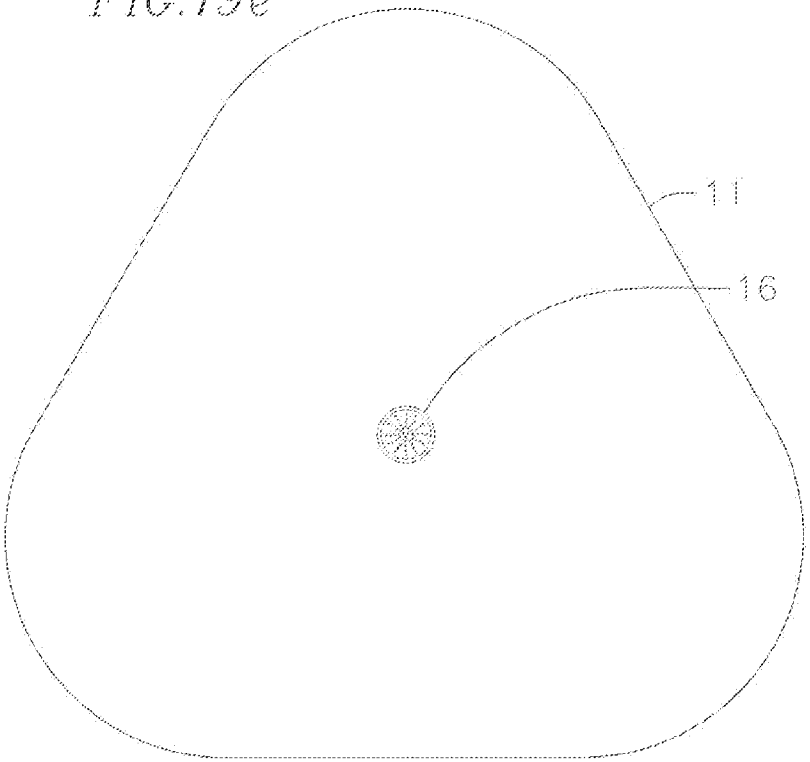
FIG. 19*e* is a top view of the central floor section of the swimming pool shown in FIG. 19*a;*
Figure 19F:
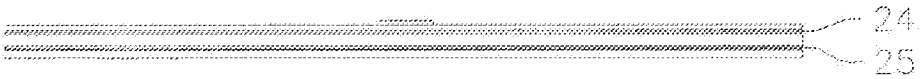
FIG. 19*f* is a side view of the central floor section shown in FIG. 19*e ;*
Figure 19H:
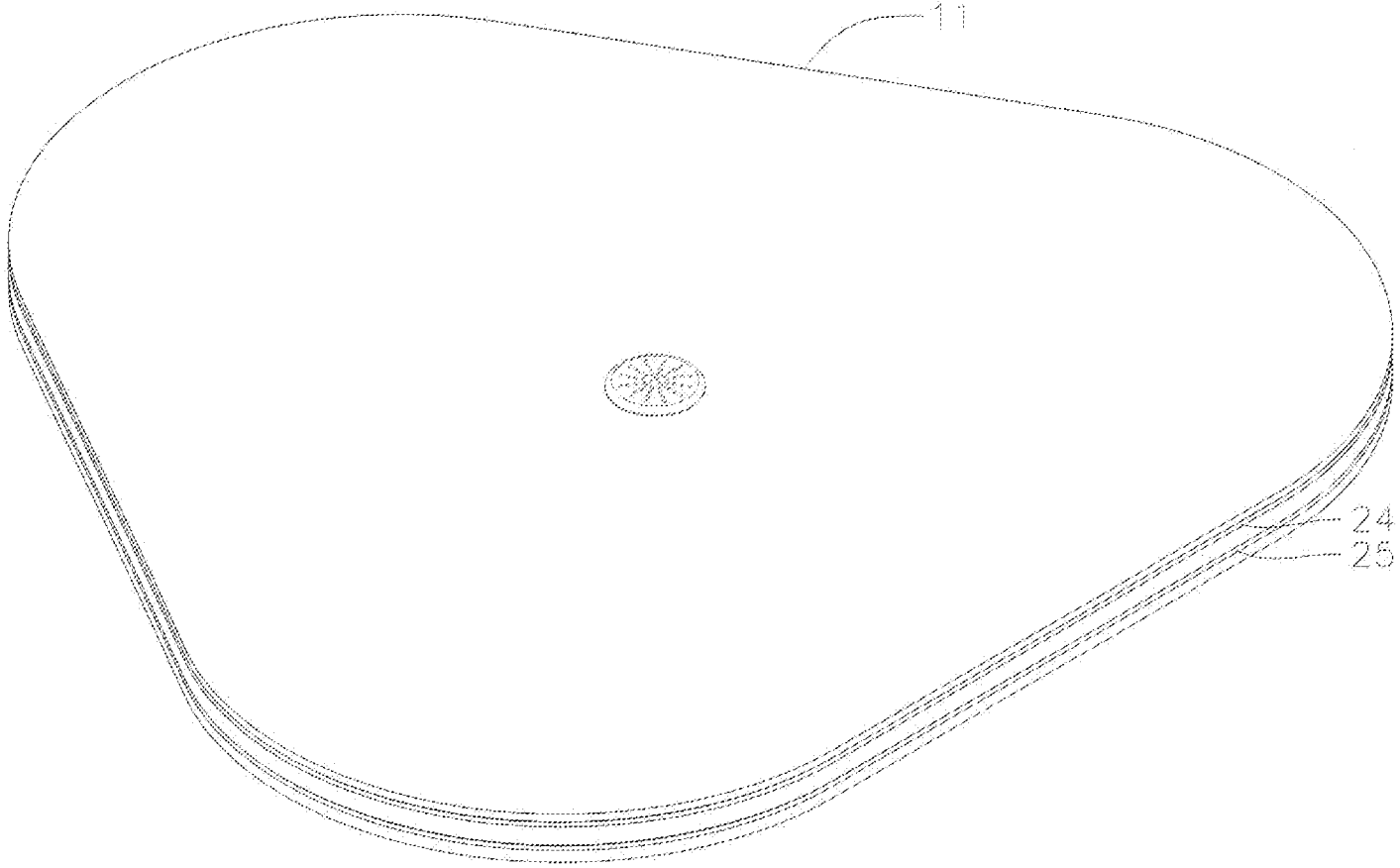
FIG. 19*h* is a perspective view of the central floor section shown in FIGS. 19*e* and 19*f;*
Figure 20A:
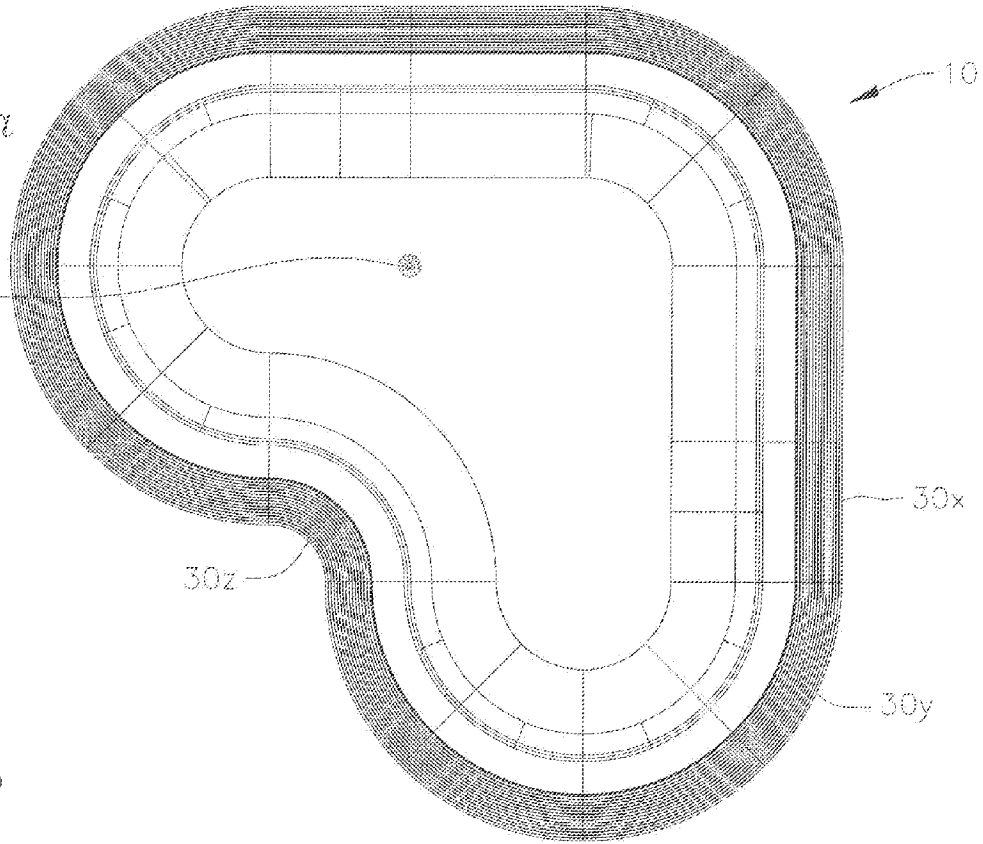
FIG. 20*a* is top plan view of an "L-shaped" swimming pool according to another embodiment of the invention.
Figure 20B:
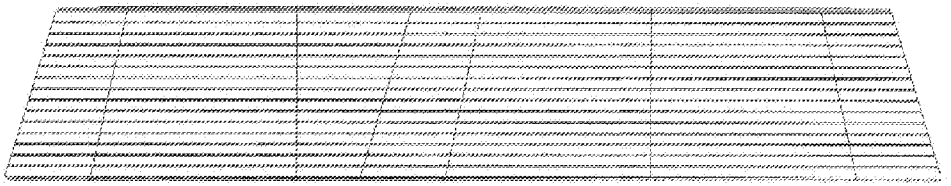
FIG. 20*b* is a side devotional view of the swimming pool shown in FIG. 19*a;*
Figure 20C:
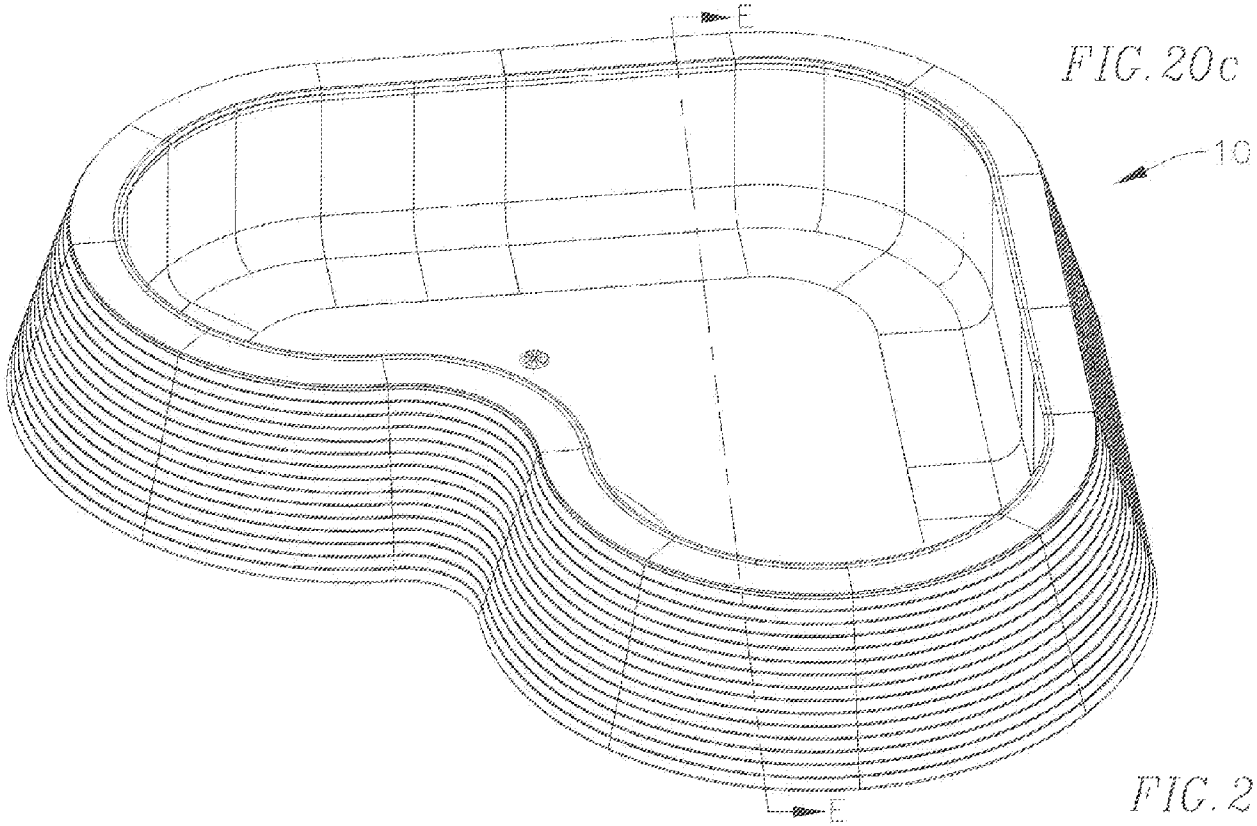
FIG. 20*c* is a perspective view of the swimming pool shown in FIG. 19*a;*
Figure 20D:
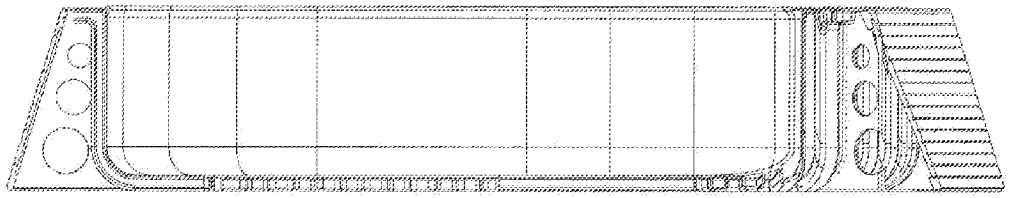
FIG. 20*d* is a sectional view of the swimming pool shown in FIG. 19*b*, taken along line E-E.
Figure 20G:
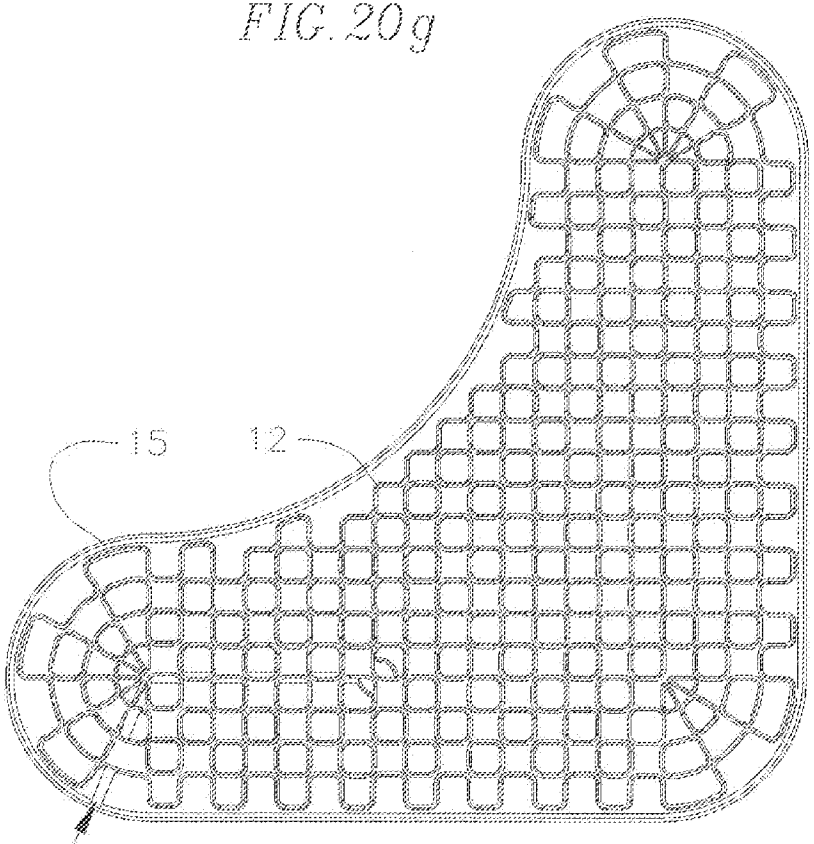
FIG. 20*g* is a bottom view of the central floor section shown in FIG. 19*e*.
Figure 20E:
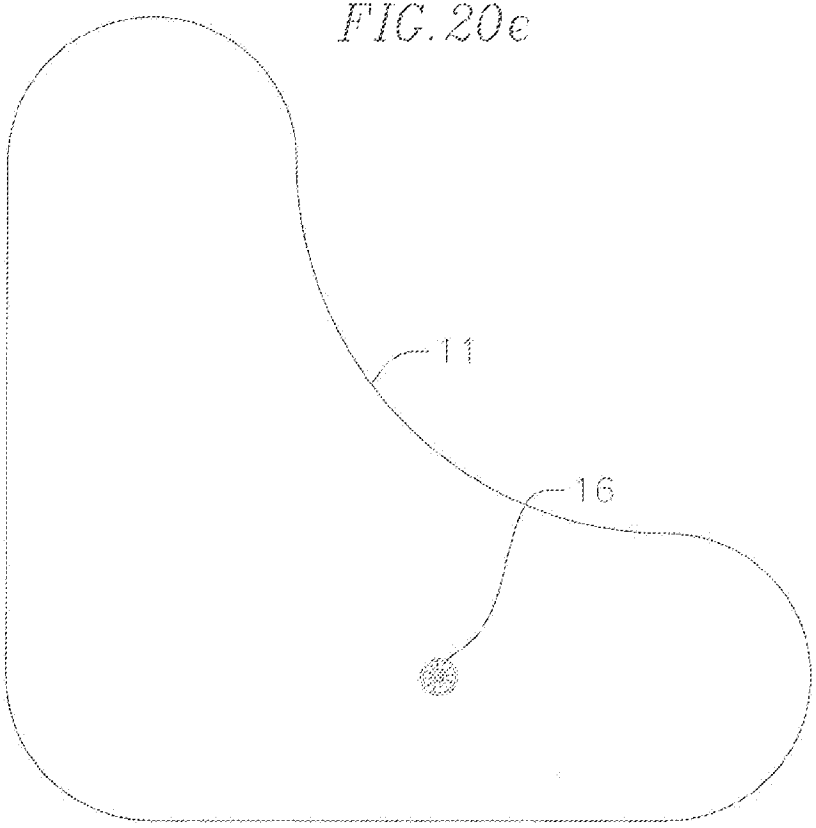
FIG. 20*e* is a top view of the central floor section of the swimming pool shown in FIG. 19*a;*
Figure 20F:
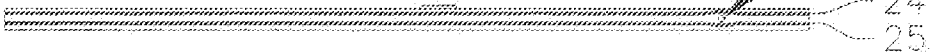
FIG. 20*f* is a side view of the central floor section shown in FIG. 19*e;*
Figure 20H:
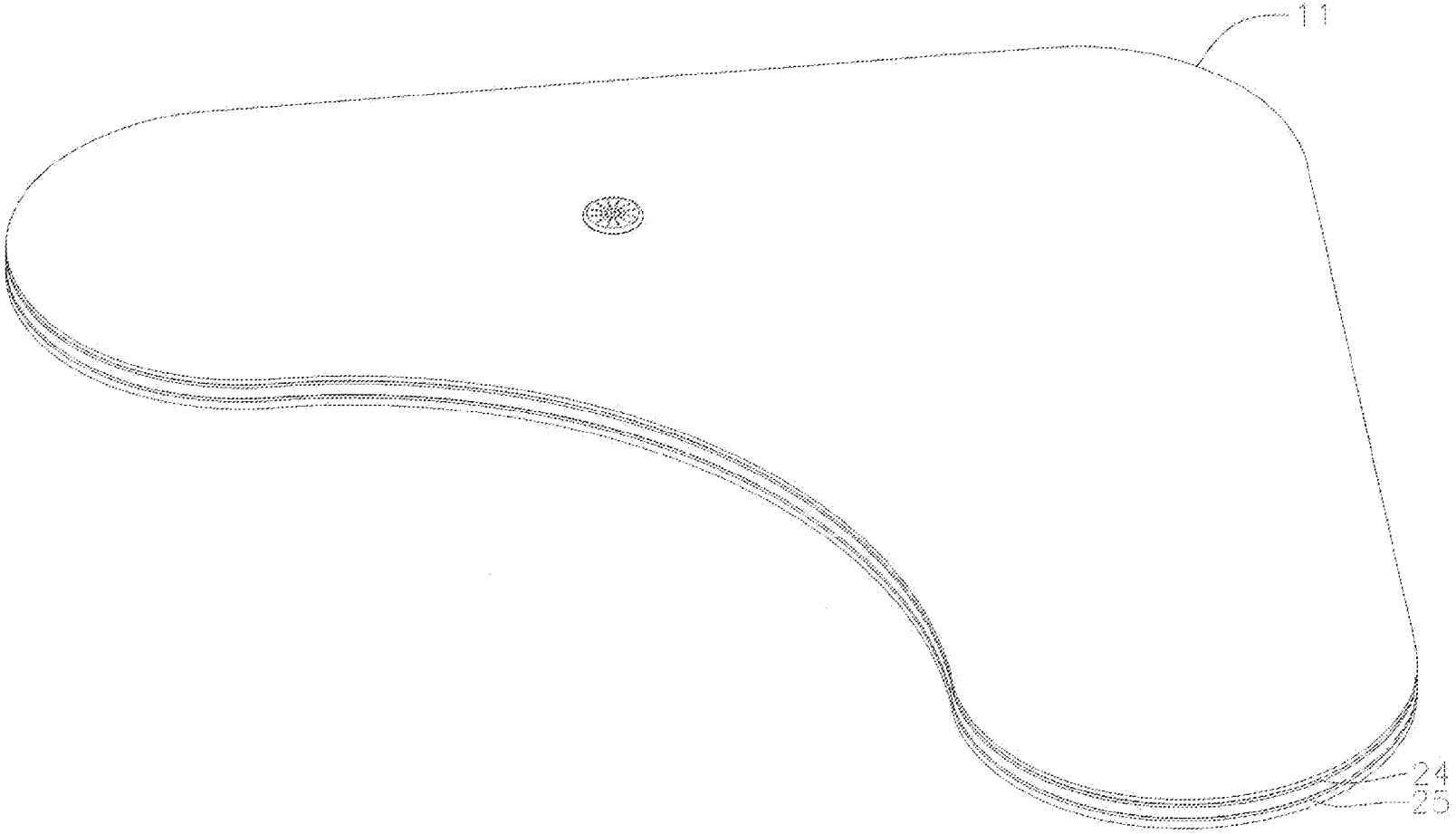
FIG. 20*h* is a perspective view of the central floor section shown in FIGS. 19*e* and 19*f.*

A "triangular" pool is shown in FIGS. 19*a*-19*b* and includes a triangular floor section 20 surrounded by and attached to six wall sections, including three straight wall sections 30*x* and three curved wall sections 30*y*. These are coupled to one another as previously described. The floor section 20 includes a primary floor 11 and subfloor 12. The floor and wall sections are constructed and joined together in substantially the same manner as previously described.

FIGS. 20*a*-20*h* show an "L-shaped" pool, which has an L-shaped floor section 20 and multiple walls sections, including straight sections 30*x*, curved (concave pool-facing) sections 30*y*, and curved (convex pool-facing) sections 30*z*. The floor and wall sections are constructed and joined together in substantially the same manner as the pools depicted in FIGS. 15-19. Other shapes are possible, including asymmetrical and irregular shapes. In addition, the pool floor can be constructed of more than a single floor section. In that case, two or more floor sections are coupled together—to each other and to adjacent wall sections—using water-tight seams or joints formed in substantially the same manner as previously described.

The size and number of modular floor, wall, and skirt sections described herein are selected to meet any desired pool dimension and shape, and the sections are formed of any of a number of different materials selected for water resistance, strength, structural stability, weight, ease of construction and assembly, UV resistance, resistance to chlorine and other chemicals, resistance to salt water, and/or cost. Examples include plastics, such as high density polyethylene polypropylene, various polyolefin copolymers, polyurethane, polystyrene, ASB and other copolymers; composite materials, such as fiberglass, carbon fibers, prepreg resins, etc. One or more additives, such as UV absorbers (e.g., titanium dioxide), chlorine guards, etc., can be added. The individual floor, wall, and skirt sections are formed using any technique suitable for the material. Examples include mold injection, thermoforming, cast molding, and blow molding.

Because the pool is made of modular sections, assembly will be straightforward and relatively quick. It is estimated that, for an oval-shaped pool (16'×10'), four man-hours will be required to assemble the pool on a flat, level surface, using common hand or power tools. The pool can also be easily disassembled for relocation. In addition, in one embodiment of the invention, some or all of the wall sections are interchangeable. As a result, a pool owner who has purchased a pool having a particular geometric shape can transform the pool into another shape by adding or removing wall sections. For example, a circular swimming pool can be transformed into an oval or square swimming pool by adding two or more "straight" wall sections. Water-tight joints are formed between adjacent wall sections and between the wall sections and the central floor section, because the grooves, channels, and elastomeric seals mate with one another in a modular fashion. Although a liner is not needed, silicone caulk can be applied to inner surface of the pool at each seam as an extra safeguard against intrusion by water, and to improve the smoothness of the joint.

It will be appreciated that a number of variations and modifications can be made without departing from the invention. For example, each wall and floor section can meet with a single channel, rather than a pair of channels, formed between the panels. Similarly, adjacent wall sections can meet with a single channel, rather than a pair of channels, formed there between. In another embodiment, three or more channels can be employed at each joint. As another example, one or more floor or wall sections can be manufactured with a plurality of threaded bolts embedded in place to ease construction. Alternatively, threaded bolts can extend through the face 36 of the wall sections 30 into threaded holes in the floor section(s) 20, without need of securing nuts. In yet another alternative, self-taping screws can extend through the holes 46 in the face 36 of each wall section, directly into the floor section(s) 20 or primary floor 11—without need of a corresponding hole in the floor section(s) or primary floor. As another example, the pool can include a solid or mostly solid subfloor. Also, the invention is not limited to swimming pools also provides an improved modular structure for storing water and other liquids. Other variations are encompassed by the invention. Therefore although the invention has been described with reference to various features and embodiments, the invention is limited only by the appended claims and equivalents thereof.

What is claimed is:

1. A modular swimming pool, comprising:

at least one floor section, each floor section having a top surface, a bottom surface, and one or more sides, each side having at least one groove formed therein;

a plurality of wall sections attached to the floor section(s), each wall section having at least one groove formed therein;

a plurality of channels, the channels being formed by complementary pairs of the grooves in adjacent wall sections and/or floor sections;

a plurality of elastomeric seals seated in the plurality of channels; and a plurality of fasteners located near each channel and securing the plurality of wall sections to each other and/or to the at least one floor section;

wherein the elastomeric seals and fasteners create watertight joints between adjacent wall sections and/or floor sections.

2. A swimming pool as recited in claim 1, wherein each wall section is substantially wedge-shaped.

3. A swimming pool as recited in claim 1, wherein each wall section has a main panel bounded by two lateral side panels.

4. A swimming pool as recited in claim 3, wherein the main panel of each wall section includes an upper portion, a lower portion, and a middle portion.

5. A swimming pool as recited in claim 4, wherein the lower portion of each wall section has a face that abuts with a side of an adjacent floor section, and wherein the face has at least one groove that lines up with a corresponding groove in an adjacent floor section, thereby forming one of the plurality of channels, and wherein one of the elastomeric seals is located in said channel.

6. A swimming pool as recited in claim 5, wherein at least one side of each floor section has an outwardly projecting foot that extends under the face of the lower portion of an adjacent wall section.

7. A swimming pool as recited in claim 6, wherein each wall section includes a downwardly directed support member set back distally from the face of the lower portion of the main panel, and which serves as a stop for at least one foot on a corresponding floor section.

8. A swimming pool as recited in claim 3, wherein at least one of the groove(s) in each wall section is located in one of the side panels of the wall section.

9. A swimming pool as recited in claim 3, wherein each wall section is substantially wedge-shaped.

10. A swimming pool as recited in claim 1, further comprising a plurality of buttresses extending outwardly from two or more of the wall sections.

11. A swimming pool as recited in claim 10, wherein each buttress is coincident with a wall section side panel.

12. A swimming pool as recited in claim 10, wherein each buttress has one or more cutouts formed therein.

13. A swimming pool as recited in claim 12, wherein the support members form a crisscross pattern.

14. A swimming pool as melted in claim 12, wherein the support members form a honeycomb pattern.

15. A swimming pool as recited in claim 10, wherein each buttress has one or more cutouts formed therein.

16. A swimming pool as recited in claim 1, further comprising at least one buttress extending outwardly from each wall section.

17. A swimming pool as recited in claim 16, wherein each buttress is coincident with a wall section side panel.

18. A swimming pool as recited in claim 1, further comprising a plurality of cables affixed to an outer surface of at least two of the wall sections.

19. A swimming pool as recited in claim 18, further comprising a plurality of turnbuckles connected to the plurality of cables.

20. A swimming pool as recited in claim 1, further comprising (a) at least one buttress extending from each wall section, (b) a plurality of cables, and (c) a plurality of turnbuckles, and wherein each buttress has a plurality of slots formed therein, each slot has a diameter large enough to accommodate one of the cables, and the cables extend through the slots, encircle the pool, and are held in tension by the turnbuckles.

21. A swimming pool as recited in claim 1, further comprising a skirt attached to at least two of the wall sections and forming an outer perimeter of the swimming pool.

22. A swimming pool as recited in claim 21, wherein the skirt has a decorative motif formed therein or thereon.

23. A swimming pool as recited in claim 21, wherein the skirt comprises a plurality of skirt sections, each skirt section being attached to a corresponding wall section.

24. A swimming pool as recited in claim 23, wherein each skirt section is attached to at least one wall section buttress.

25. A swimming pool as recited in claim 1, further comprising a plurality of support members extending from the bottom surface of each floor section.

26. A swimming pool as recited in claim 25, wherein the support members comprise parallel floor joists.

27. A Swimming pool as recited in claim 1, wherein the pool has a single floor section, the floor section comprising a primary floor and a subfloor.

28. A modular swimming pool, comprising:

a floor section comprising a primary floor and a subfloor, the primary floor having a top surface, an under surface, and a sidewall, wherein the sidewall has at least one groove formed therein, and wherein the subfloor provides structural support for the primary floor;

a plurality of wall sections attached to the floor section, each wall section having at least one groove formed therein;

a plurality of channels, the channels being formed by complementary pairs of the grooves in adjacent wall sections and/or the floor section sidewall;

a plurality of elastomeric seals seated in the plurality of channels; and a plurality of fasteners located near each channel and securing the plurality of wall sections to each other and/or to the floor section;

wherein the elastomeric seals and fasteners create watertight joints between adjacent wall sections and/or the floor section.

* * * * *